US010259229B2

(12) United States Patent
Kimura et al.

(10) Patent No.: US 10,259,229 B2
(45) Date of Patent: Apr. 16, 2019

(54) INK CONTAINER AND PRINTER

(71) Applicant: SEIKO EPSON CORPORATION, Tokyo (JP)

(72) Inventors: Naomi Kimura, Nagano (JP); Shoma Kudo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/787,071

(22) Filed: Oct. 18, 2017

(65) Prior Publication Data

US 2018/0111380 A1 Apr. 26, 2018

(30) Foreign Application Priority Data

Oct. 25, 2016 (JP) ..... 2016-208865
Dec. 1, 2016 (JP) ..... 2016-234266

(51) Int. Cl.
*B41J 2/175* (2006.01)
*B41J 29/13* (2006.01)
*B41J 2/19* (2006.01)

(52) U.S. Cl.
CPC ..... *B41J 2/17523* (2013.01); *B41J 2/175* (2013.01); *B41J 2/1752* (2013.01); *B41J 2/17506* (2013.01); *B41J 2/17509* (2013.01); *B41J 2/17513* (2013.01); *B41J 2/17553* (2013.01); *B41J 29/13* (2013.01); *B41J 2/19* (2013.01)

(58) Field of Classification Search
CPC ..... B41J 2/17509; B41J 2/17506
See application file for complete search history.

(56) References Cited

U.S. PATENT DOCUMENTS

2005/0030358 A1* 2/2005 Haines ..... B41J 2/17513 347/93
2005/0134661 A1* 6/2005 Miyazawa ..... B41J 2/17503 347/86
2006/0227190 A1 10/2006 Ishizawa et al.
2007/0103520 A1* 5/2007 Wu ..... B41J 2/17513 347/86
2009/0167826 A1 7/2009 Ishizawa et al.
2009/0295885 A1* 12/2009 Wanibe ..... B41J 2/17506 347/86
2013/0061982 A1* 3/2013 Qin ..... B41J 2/17506 141/18
2015/0130879 A1* 5/2015 Kimura ..... B41J 2/17506 347/85
2016/0207319 A1* 7/2016 Shirono ..... B41J 2/17513
2017/0355196 A1* 12/2017 Shinada ..... B41J 2/17506

FOREIGN PATENT DOCUMENTS

JP 2006-306035 A 11/2006
JP 2008-183836 A 8/2008
JP 2012-232595 A 11/2012
JP 2014014932 A * 1/2014

* cited by examiner

*Primary Examiner* — Shelby L Fidler

(57) ABSTRACT

An ink container comprises an ink chamber configured to contain ink that is supplied to an ink ejection head; and an ink inlet flow path portion arranged to connect a first end portion that is open to outside of the ink chamber with a second end portion that is open to inside of the ink chamber and configured to inject the ink into the ink chamber. At least part of the ink inlet flow path portion is formed by sealing a groove that is defined by flow path walls with a first film and a second film attached to the flow path walls.

14 Claims, 30 Drawing Sheets

INK CONTAINER AND PRINTER

CROSS-REFERENCE TO RELATED APPLICATIONS

The present application claims the priority based on Japanese Patent Applications No. 2016-208865 filed on Oct. 25, 2016, and No. 2016-234266 filed on Dec. 1, 2016, the disclosures of which are hereby incorporated by reference in their entirety.

BACKGROUND

Field

The present invention relates to an ink container configured to contain ink therein and a printer equipped with the ink container.

Related Art

An inkjet printer has been known to perform printing on a medium by ejecting ink that is supplied from an ink container configured to contain ink therein, from an ink ejection head. An example of such ink container is an ink cartridge detachably mounted to the printer (as described in, for example, JP 2008-183836A).

A used ink cartridge after consumption of ink may be refilled with ink to be reusable. More specifically, the ink cartridge is provided with an ink injection port and an air vent port. An ink injection needle (ink inlet flow path portion) included in an ink bottle configured to contain ink for refill and an air vent nozzle are respectively inserted into the ink injection port and the air vent port, and ink is supplied via the ink injection needle.

In a configuration that an ink pathway (ink flow path) which ink flows in is separated from an air pathway for removal of the air and gas liquid exchange is performed by removing the air by an amount of the inflow ink, however, the gas liquid exchange may be performed in a thick ink pathway. This may cause unstable inflow of ink.

There is, on the other hand, a difficulty in manufacturing a hollow needle-type ink injection needle that forms a narrow ink pathway, integrally with an ink bottle or an ink cartridge.

This problem is not limited to the ink cartridge configured to be refilled with ink or the printer to which such an ink cartridge is detachably mounted but is practically commonly found in any ink container configured to be refilled with ink and any printer equipped with such an ink container.

By taking into account the foregoing, an object of the present invention is to provide an ink container that enables a long and thin ink inlet flow path portion having gas liquid exchange capability to be readily manufactured, as well as a printer equipped with such an ink container.

SUMMARY

The following describes some aspects to solve the above problem and their functions and effects.

An ink container provided to solve the above problem comprises an ink chamber configured to contain ink that is supplied to an ink ejection head; and an ink inlet flow path portion arranged to connect a first end portion that is open to outside of the ink chamber with a second end portion that is open to inside of the ink chamber and configured to inject the ink into the ink chamber. At least part of the ink inlet flow path portion is formed by sealing a groove that is defined by a flow path wall with a film attached to the flow path wall.

In the ink container of this aspect, at least part of the ink inlet flow path portion is formed by sealing the groove with the film. The thickness of the ink inlet flow path portion can thus be regulated by specifying the depth and the width of the groove. This configuration enables the long and thin ink inlet flow path portion having the gas liquid exchange capability to be readily manufactured.

In the ink container of the above aspect, the ink inlet flow path portion may comprise a plurality of ink flow paths arranged to connect the first end portion with the second end portion.

In the ink container of this aspect, the ink inlet flow path portion includes the plurality of ink flow paths, and at least one ink flow path may serve a flow path for discharging the air. This configuration enables the ink flow path serving to flow ink into the ink chamber to be separated from the flow path serving to discharge the air from the ink chamber and thereby ensures stable supply of ink into the ink chamber.

In the ink container of the above aspect, at least one ink flow path out of the plurality of ink flow paths may be configured to include a first flow path portion; and a second flow path portion that has a larger sectional area than a sectional area of the first flow path portion.

For example, in the process of flowing ink into the ink chamber, the pressure of ink against the air and the pressure of the air against ink may be balanced out in the plurality of ink flow paths. This may cause accumulation of ink in these ink flow paths and interfere with the inflow of ink into the ink chamber. In the ink container of this aspect, however, at least one ink flow path is configured to include the first flow path portion of the smaller sectional area and the second flow path portion of the larger sectional area. This configuration disturbs the balance of pressure between the air and the ink. This facilitates division of the functions of the plurality of ink flow paths as the flow path for the air discharge and the flow path for the ink inflow.

In the ink container of the above aspect, the second end portions of the plurality of ink flow paths may be located at an identical height in the ink chamber.

This configuration that has the second end portions of the plurality of ink flow paths at the same height facilitates manufacture of the ink inlet flow path portion, compared with a configuration that the second end portions are provided at different heights.

In the ink container of the above aspect, a second end portion-side of the ink inlet flow path portion may be located in an upper space of the ink chamber and the second end portion-side of the ink inlet flow path portion may be formed to be protruded downward from a ceiling wall that is configured to define the ink chamber.

Ink is accumulated in the lower portion of the ink chamber, and the air is accumulated in the upper space in the ink chamber. The configuration that the ink inlet flow path portion is protruded from the ceiling wall and that the second end portion is located in the upper space of the ink chamber enables the air inside of the ink chamber to be readily discharged through the ink inlet flow path portion.

In the ink container of the above aspect, the ink chamber may be defined by a ceiling wall and a side wall. The side wall may be extended in a direction intersecting with the ceiling wall, the side wall may stand in a vertical direction when the ink container is in use, and the side wall may include a visible surface through which the ink inside the ink chamber is visually recognized from outside. The visible surface may be provided with an upper limit indicator that gives a rough indication of an upper limit of an amount of refilled ink. The second end portion of the ink inlet flow path portion may be located at a position corresponding to the upper limit indicator in the vertical direction.

In the ink container of this aspect, in the process of ink refill into the ink chamber, the inflow of ink raises the liquid level of the ink contained in the ink chamber. When the liquid level reaches the upper limit indicator, the second end portion of the ink inlet flow path portion is blocked by the ink, and no more air is flowed from the second end portion into the ink inlet flow path portion. This configuration accordingly enables the ink refill into the ink chamber to be stopped at a position corresponding to the upper limit indicator.

The ink container of the above aspect may further comprise a buffer chamber provided along the ink inlet flow path portion; and a communication portion configured to communicate with the buffer chamber and the ink chamber.

In the ink container of this aspect, the buffer chamber is provided along the ink inlet flow path portion, so as to reinforce the ink inlet flow path portion. This configuration reduces the possibility of damage of the ink inlet flow path portion.

The ink container of the above aspect may further comprise an air communication portion configured to communicate with the buffer chamber and outside air. when the ink container is in use, the communication portion may communicate with the ink chamber at a position above the second end portion.

For example, when the ink chamber is sealed, the air is likely to be expanded by the effect of, for example, a temperature change, so as to press the liquid surface of ink and press the ink out of the ink chamber. In the ink container of this aspect, however, the buffer chamber is configured to communicate with the outside air by the air communication portion. The ink chamber and the buffer chamber are arranged to communicate with each other by the communication portion that is open at a position above the second end portion. This configuration reduces the possibility that ink is pressed out of the ink chamber even when the ink is contained up to the height of the second end portion in the ink chamber.

In the ink container of the above aspect, an upper space of the ink chamber above the second end portion may be divided into a first upper space and a second upper space by the ink inlet flow path portion when the ink container is in use. The ink container may further comprise a communication path configured to communicate with the first upper space and the second upper space.

In the configuration that the upper space in the ink chamber is parted into the first upper space and the second upper space by the ink inlet flow path portion, the communication path causes the first upper space and the second upper space to communicate with each other and to further communicate with the buffer chamber.

In the ink container of the above aspect, when the ink container is in use, an upper space of the ink chamber above the second end portion may have a volume that is larger than a volume of the ink inlet flow path portion.

In the process of ink refill into the ink chamber by connection of an ink bottle configured to contain ink for refill therein with the ink inlet flow path portion, when the second end portion of the ink inlet flow path portion is blocked by the ink to interfere with the introduction of the air from the second end portion, the ink refill from the ink bottle into the ink chamber is stopped. Disconnection of the ink bottle from the ink inlet flow path portion causes the atmospheric pressure to be applied to the ink remaining in the ink inlet flow path portion and thereby causes the remaining ink to be flowed into the ink chamber. In the ink container of this aspect, the volume of the upper space of the ink chamber is made larger than the volume of the ink inlet flow path portion. This configuration accordingly reduces the possibility that the ink flows into the buffer chamber even when the ink remaining in the ink inlet flow path portion is flowed into the ink chamber.

In the ink container of the above aspect, the buffer chamber may be formed by sealing a buffer recess that has one open surface, with the film.

In the ink container of this aspect, the buffer recess and the groove are sealed with the film, so as to form the buffer chamber and the ink inlet flow path portion. This configuration facilitates manufacture of the ink container.

In the ink container of the above aspect, the film may include a first film sealing a portion of the groove and forming a portion of the ink inlet flow path portion; and a second film sealing a portion of the groove and forming the second end portion of the ink inlet flow path portion. The ink chamber may be formed by sealing a chamber recess that has one open surface, with the second film.

In the ink container of this aspect, the chamber recess and the groove are sealed with the second film, so as to form the ink chamber and the second end portion of the ink inlet flow path portion. This configuration facilitates manufacture of the ink container.

The ink container of the above aspect may further comprise a reservoir portion located at a position below the first end portion when the ink container is in use, and configured to accumulate ink flowing from the first end portion to an outside of the ink inlet flow path portion. The reservoir portion may be defined by a ceiling wall defining the ink chamber; a reservoir wall standing upward from the ceiling wall and including an opening on part of a lateral side; and a film sealing the opening that faces the lateral side of the reservoir wall, and the reservoir portion may be arranged to be open upward.

In the ink container of this aspect, the ink spilled out of the ink inlet flow path portion is accumulated in the reservoir portion. This configuration reduces the possibility that ink is spread over the periphery of the ink container. This reservoir portion is readily formed by using the film provided to seal the ink inlet flow path portion.

A printer provided to solve the above problem comprises the ink container of any of the above aspect; an ink ejection head configured to eject the ink; a housing configured to place the ink container and the ink ejection head therein; and an operation panel provided on the housing. The operation panel includes a display unit. The ink container is arranged such that at least part of the ink container is located at a height equal to a height of the operation panel. During injection of the ink into the ink chamber through the ink inlet flow path portion, the first end portion of the ink inlet flow path portion is located above the display unit.

In the printer of this aspect, the first end portion is located above the display unit. This configuration facilitates the refill operation for injecting ink from the first end portion into the ink inlet flow path portion, compared with a configuration that the first end portion and the display unit are located at the same height or a configuration that the first end portion is located below the display unit.

The ink container of the above aspect may further comprise a buffer chamber provided in middle of an air communication path that is configured to communicate with the ink chamber and outside air. The buffer chamber may include a wall configured to introduce the ink from a connection port between the air communication path on an ink chamber-side and the buffer chamber in a direction toward center of the buffer chamber.

In the ink container of this aspect, when ink flows into the buffer chamber, the ink is introduced in the direction toward the center of the buffer chamber. This configuration causes ink to be accumulated in the buffer chamber. This reduces the possibility that ink is leaked out through the air communication path and thereby reduces the possibility that the periphery of the ink container is stained with ink.

DETAILED DESCRIPTION

First Embodiment

The following describes a first embodiment of a printer with reference to the drawings. The printer of the embodiment is configured to print (record) letters, images and the like on a medium such as paper by ejecting ink onto the medium.

Figure 1:
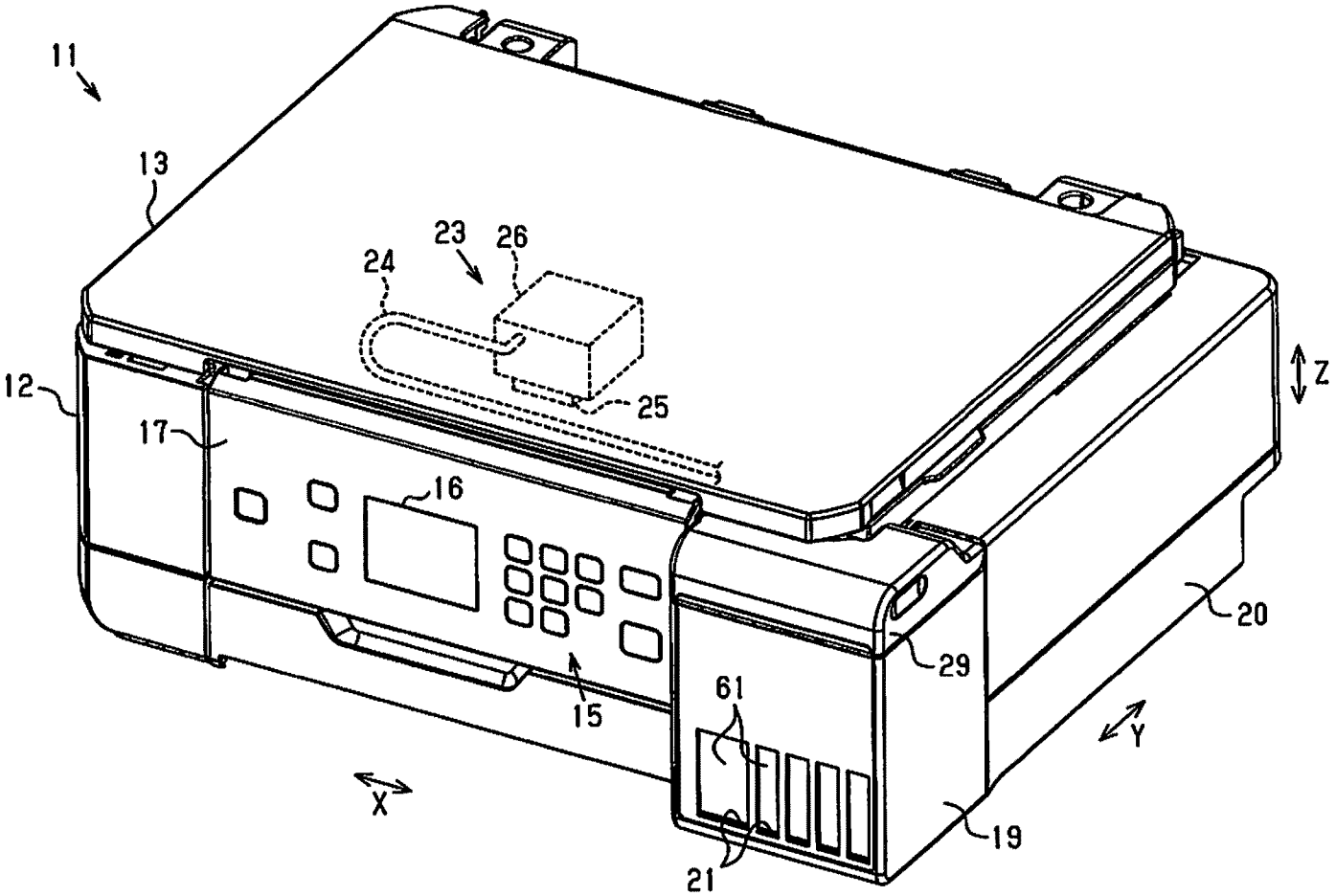
FIG. 1 is a perspective view illustrating a complex machine including a printer according to a first embodiment.

As shown in FIG. 1, a complex machine 11 includes a printer 12 and an image scanning device 13 placed on the printer 12 to cover an upper portion of the printer 12 and is in an approximately rectangular parallelepiped shape as a whole.

According to this embodiment, an opposite direction of gravity is specified as an upward direction, and the direction of gravity is specified as a downward direction. FIG. 1 illustrates the complex machine 1 assumed to be placed on a horizontal plane, where a direction along the upward direction and the downward direction is defined as a vertical direction Z, and directions along the horizontal direction are defined as a width direction X and a depth direction Y. Accordingly, the width direction X, the depth direction Y and the vertical direction Z intersect with (or preferably are orthogonal to) one another. One end side in the depth direction Y is specified as a front face side or front side, and the other end side opposite to the one end side is specified as a rear face side or rear side. One end side in the width direction X viewed from the front face side may be called right side, and the other end side may be called left side.

An operation panel 17 including an operation unit 15 configured to have buttons and the like for various operations of the complex machine 11 and a display unit 16 configured to display information on the printer 12 and the complex machine 11 and the like is provided on the front face side of the printer 12. Additionally, a container unit 19 including at least one (according to this embodiment, five) ink container 18 (shown in FIG. 3) placed therein is provided on the right side of the operation panel 17. The ink container 18 is provided inside of a housing 20 of the printer 12, and at least one (according to this embodiment, five) window 21 is formed in the housing 20 corresponding to each ink container 18.

A printing assembly 23 configured to perform printing on a medium (not shown) by adhesion of ink onto the medium and a supply portion 24 configured to include a tube arranged to supply the ink contained in the ink container 18 to the printing assembly 23 and the like are provided inside of the housing 20. The printing assembly 23 includes an ink ejection head 25 configured to eject ink from a nozzle (not shown) and a carriage 26 configured to hold the ink ejection head 25 and to reciprocate the ink ejection head 25 along the width direction X (scanning direction). The printing assembly 23 performs printing on the medium by ejecting ink from the moving ink ejection head 25 toward the medium.

As described above, the operation panel 17 is provided on the housing 20, and the ink containers 18, the supply portions 24, the ink ejection head 25, the carriage 26 and the like are placed in the housing 20. According to this embodiment, a plurality of the supply portions 24 are provided individually corresponding to the respective ink containers 18. Only one supply portion 24 is, however, illustrated in FIG. 1 for the simplicity of illustration.

Figure 2:
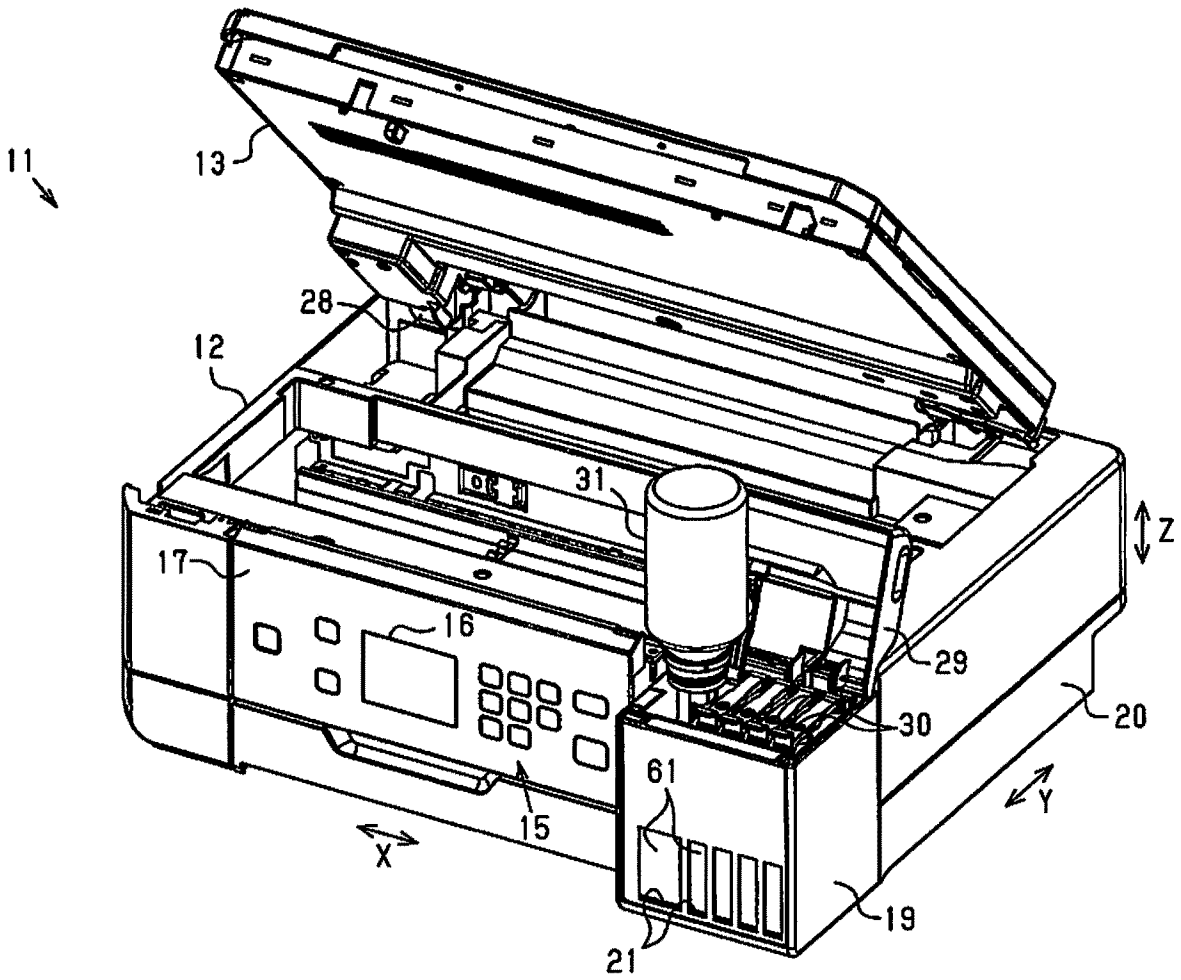
FIG. 2 is a perspective view illustrating the complex machine during refill of ink into an ink container.

As shown in FIG. 2, the image scanning device 13 is mounted via a rotating mechanism 28, such as a hinge, provided on the rear face side. The image scanning device 13 is arranged to be openable and closable relative to the printer 12 to be rotated between a closed position shown in FIG. 1 and an open position shown in FIG. 2. When the image scanning device 13 is located at the open position, a cover 29 of the container unit 19 and caps 30 mounted to the ink containers 18 (shown in FIG. 3) are allocated to be opened and closed. In the process of filling ink into the ink container 18, as shown in FIG. 2, the image scanning device 13, the cover 29 and the caps 30 are located at the open position, and an ink bottle 31 containing ink for refill is connected with the ink container 18.

The following describes a configuration for mounting the ink containers 18 to the printer 12 and an arrangement of the ink containers 18.

Figure 3:
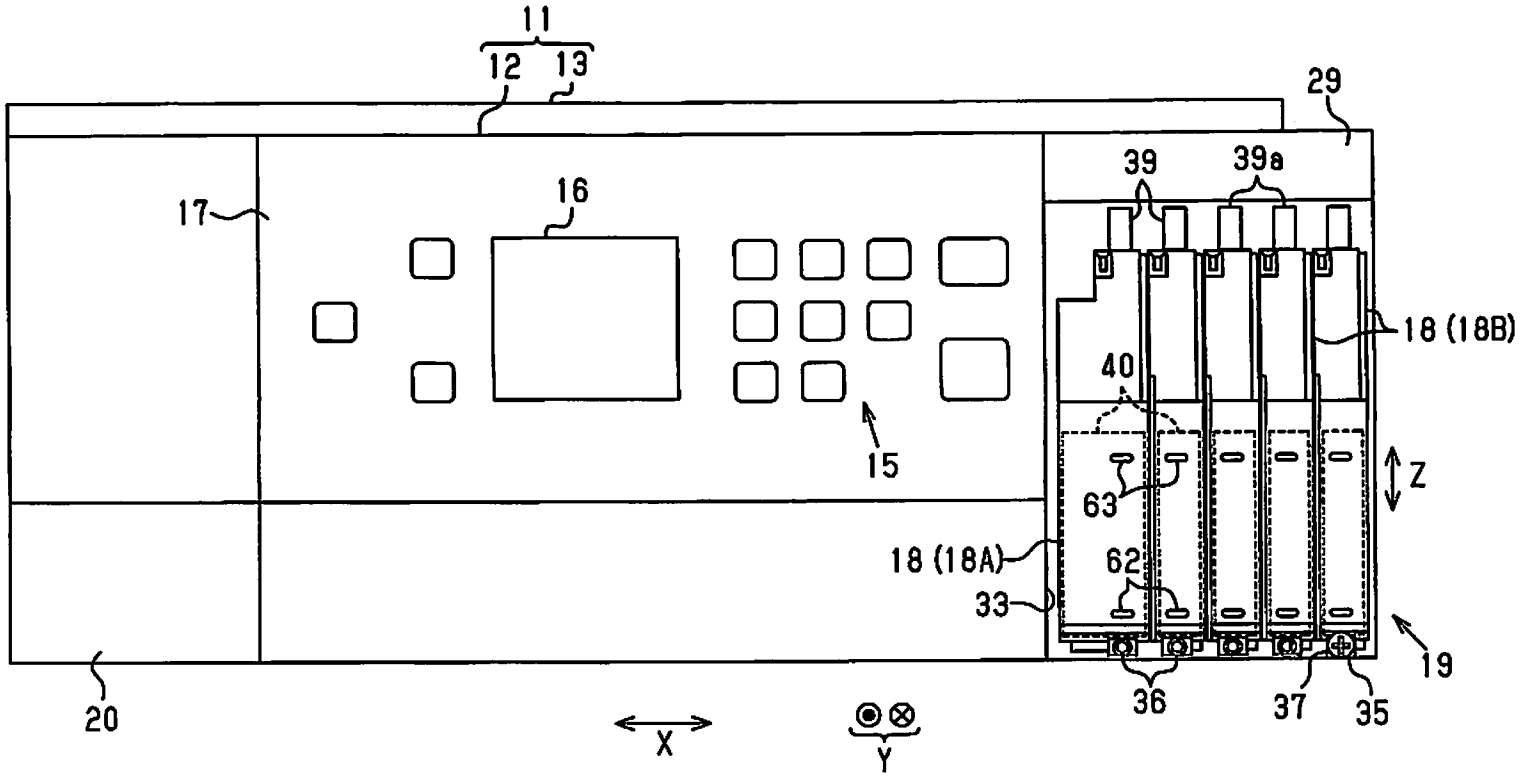
FIG. 3 is a front view illustrating the complex machine with omission of a housing of a tank unit.

As shown in FIG. 3, the container unit 19 includes a mounting structure 33 which the ink containers 18 are mountable to. A first ink container 18A and second ink containers 18B having different ink capacities are arrayed along the width direction X and are mounted to the mounting structure 33. Different types of inks (for example, different color inks such as cyan, magenta, yellow and black or different coloring agents such as pigment and dye) are contained in the respective ink containers 18.

According to this embodiment, one first ink container 18A for black ink having a larger capacity is provided on the operation panel 17-side, and four second ink containers 18B for color inks having smaller capacities than that of the first ink container 18A are provided. The plurality of second ink containers 18B have an identical configuration. Common components to the first in container 18A and the second ink container 18B are expressed by like reference signs, for the purpose of omitting duplicated description.

Figure 4:
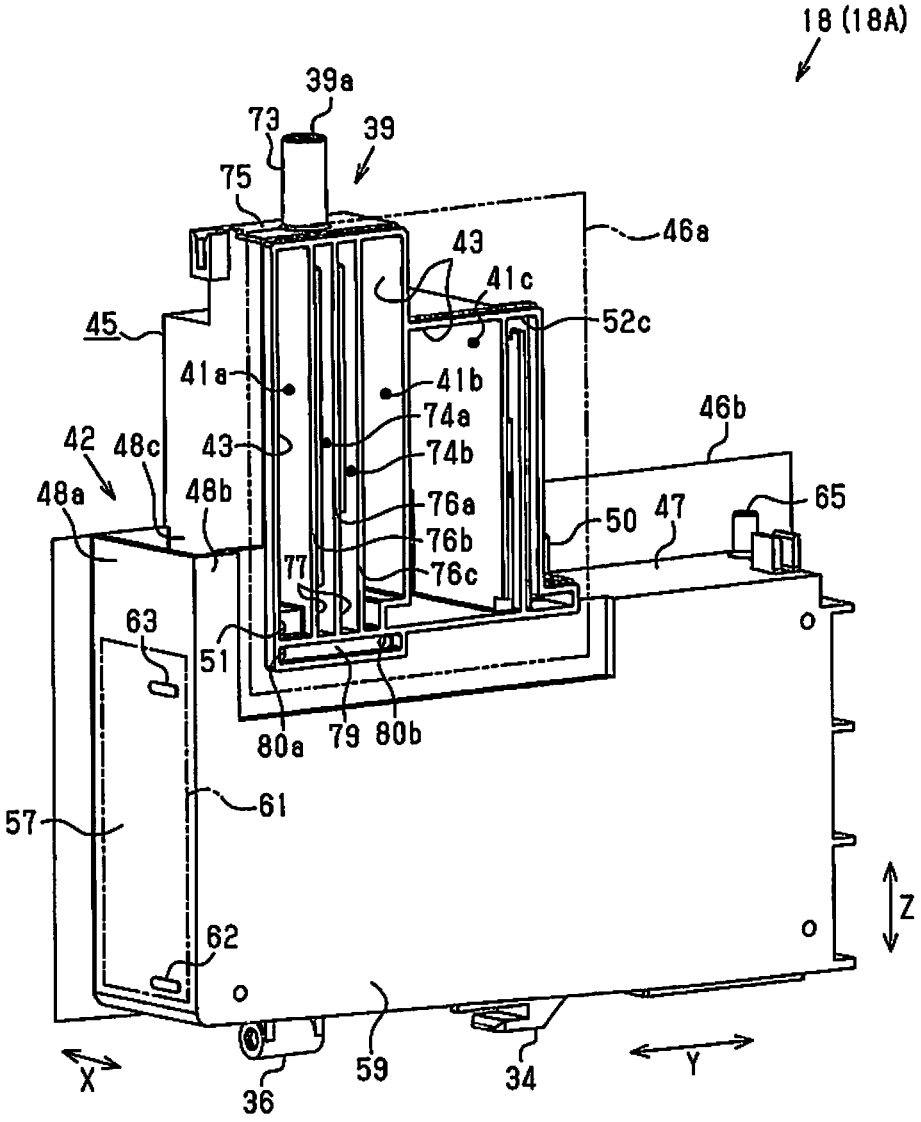
FIG. 4 is a perspective view illustrating a first ink container viewed from the right side.

As shown in FIG. 3 and FIG. 4, the ink container 18 is provided with a claw element 34 configured to engage with the mounting structure 33 and a screwed element 36 configured to receive a mounting screw 35 screwed therein. Locking elements 37 are provided on the mounting structure 33 to lock the mounting screws 35 (only one locking element 37 is illustrated in FIG. 3).

As shown in FIG. 3, in the state that the claw element 34 is engaged with the mounting structure 33, the mounting screw 35 is locked by the locking element 37 and is screwed to the screwed element 36, so that the ink container 18 is fastened to the mounting structure 33. This causes at least part of the ink container 18 to be placed at the same height as that of the operation panel 17.

When the ink container 18 is fastened to the mounting structure 33, the printer 12 may be set in a use state to be ready for use and may be set in a refill state in which ink is injected into the ink chamber 40 via an ink inlet flow path portion 39 which the ink bottle 31 is connected to for ink refill. In this refill state, one end portion 39*a* of the ink inlet flow path portion 39 is located above the operation unit 15 and the display unit 16.

The following describes the configuration of the first ink container 18A.

Figure 5:
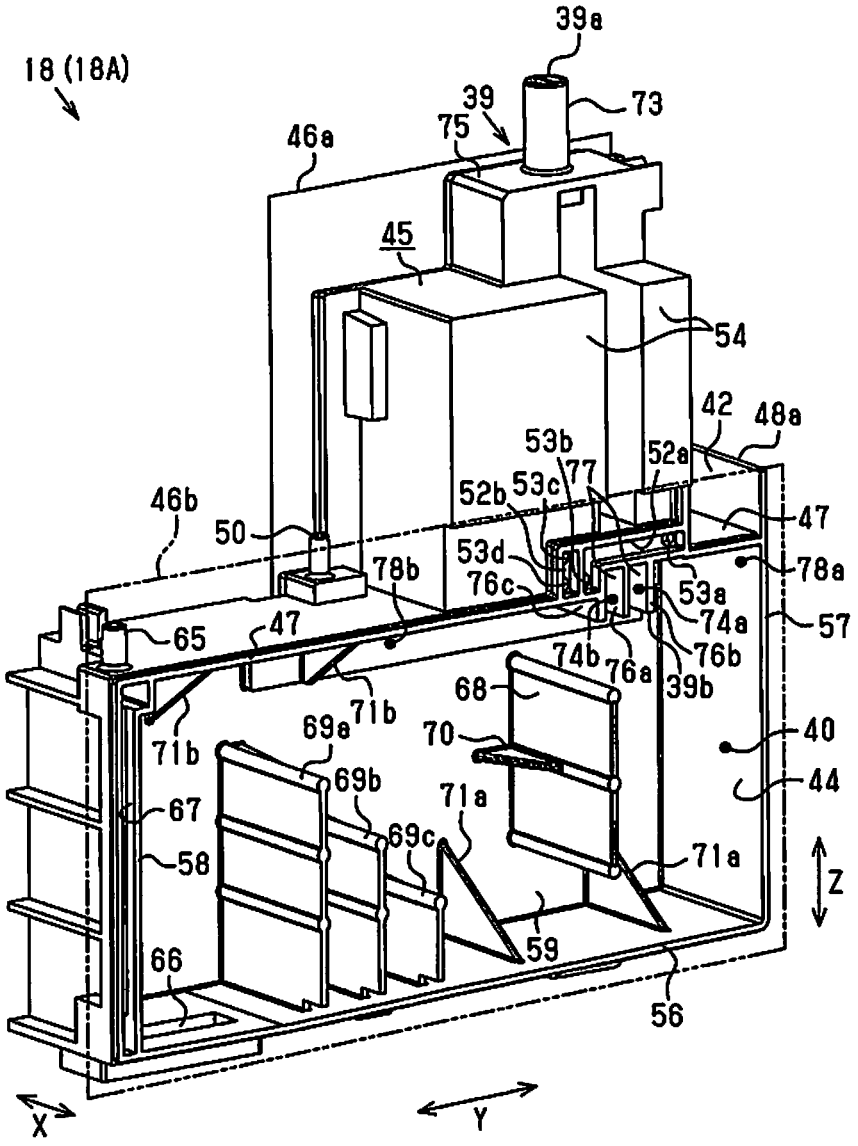
FIG. 5 is a perspective view illustrating the first ink container viewed from the left side.

As shown in FIG. 4 and FIG. 5, the first ink container 18A is provided with an ink chamber 40 configured to contain ink that is to be supplied to the ink ejection head 25, and at least one (according to this embodiment, three) buffer chamber, e.g., buffer chambers 41*a* to 41*c*, placed above the ink chamber 40. Additionally, the first ink container 18A is provided with a reservoir portion 42 that is located at a position below the first end portion 39*a* of the ink inlet flow path portion 39 in the use state of the first ink container 18A and is configured to accumulate ink flowing out of the first end portion 39*a* down to outside of the ink inlet flow path portion 39.

The first buffer chamber 41*a* and the second buffer chamber 41*b* are provided on at least one side of (according to this embodiment, on respective sides of) the ink inlet flow path portion 39 in the depth direction Y to be arranged along the ink inlet flow path portion 39. The ink inlet flow path portion 39 is arranged to connect the first end portion 39*a* that is open to outside of the ink chamber 40 with a second end portion 39*b* that is open to inside of the ink chamber 40 and enable ink to be injected into the ink chamber 40.

The first ink container 18A is also provided with a container case 45 that includes at least one (according to this embodiment, three) buffer recesses 43 having one open face (open right face), and a chamber recess 44 having one open face (open left face). The buffer chambers 41*a* to 41*c* are formed by sealing the buffer recesses 43 with a first film 46*a* that is one example of the film. Additionally, the ink chamber 40 is formed by sealing the chamber recess 44 with a second film 46*b* that is one example of the film.

The reservoir portion 42 is defined by a ceiling wall 47 arranged to define the ink chamber 40, reservoir walls 48*a* to 48*c* provided to stand above the ceiling wall 47 and have a lateral (left-side) partial opening, and the second film 46*b* placed to seal the lateral (left-side) opening of the reservoir walls 48*a* to 48*c*, and is formed to be open upward. More specifically, the reservoir walls 48*a* to 48*c* include the first reservoir wall 48*a* located on the front side, the second reservoir wall 48*b* located on the right side and the third reservoir wall 48*c* located on the rear side. The third reservoir wall 48*c* is arranged to separate the reservoir portion 42 from the first buffer chamber 41*a*.

The following describes the buffer chambers 41*a* to 41*c*.

Figure 6:
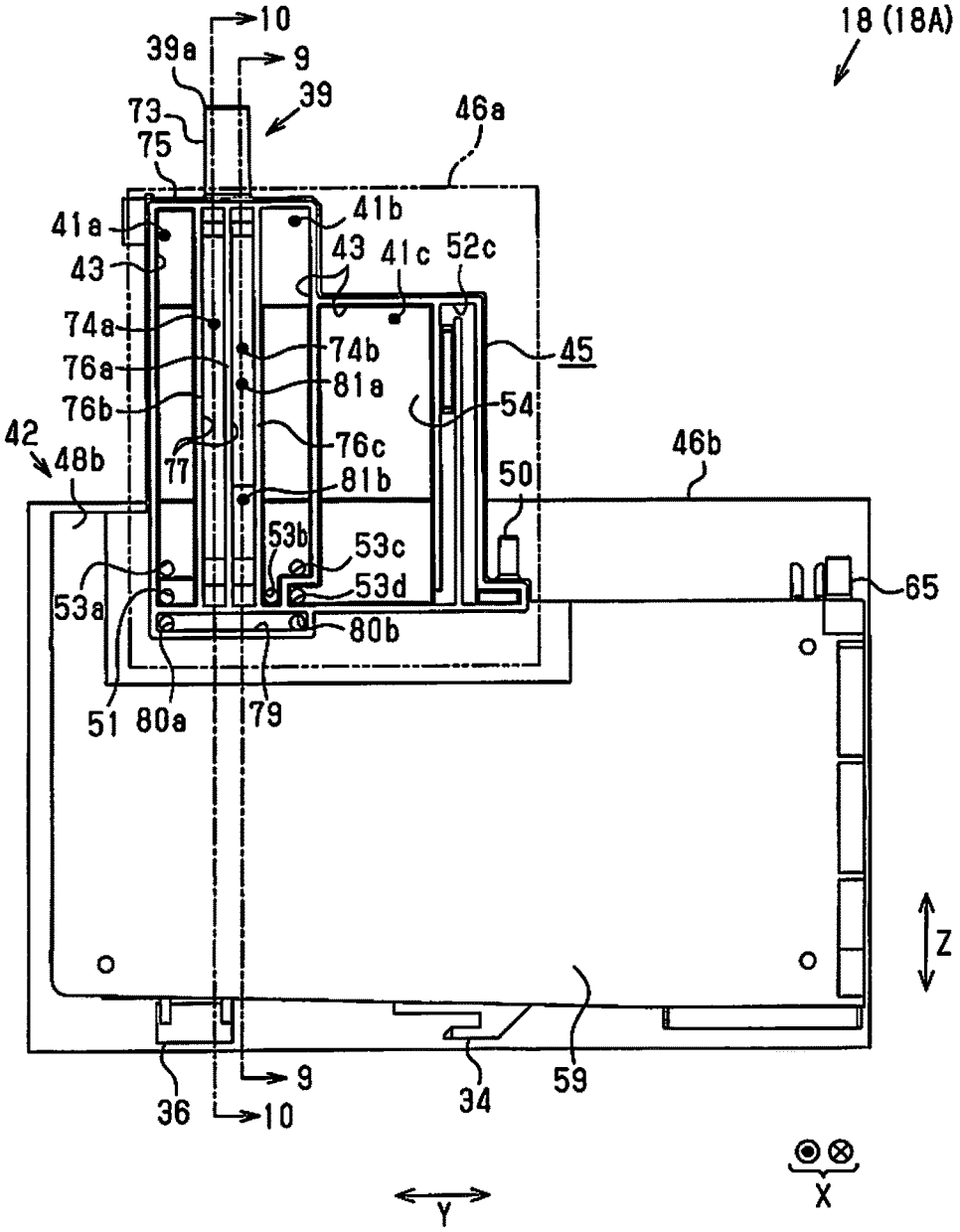
FIG. 6 is a right side view illustrating the first ink container.

As shown in FIG. 4 and FIG. 6, the first ink container 18A includes the first buffer chamber 41*a* provided on the front side of the ink inlet flow path portion 39, and the second buffer chamber 41*b* and the third buffer chamber 41*c* provided on the rear side of the ink ejection flow path portion 39. Additionally, the first ink container 18A includes an air communication portion 50 configured to cause the third buffer chamber 41*c* to communicate with the atmosphere.

Figure 7:
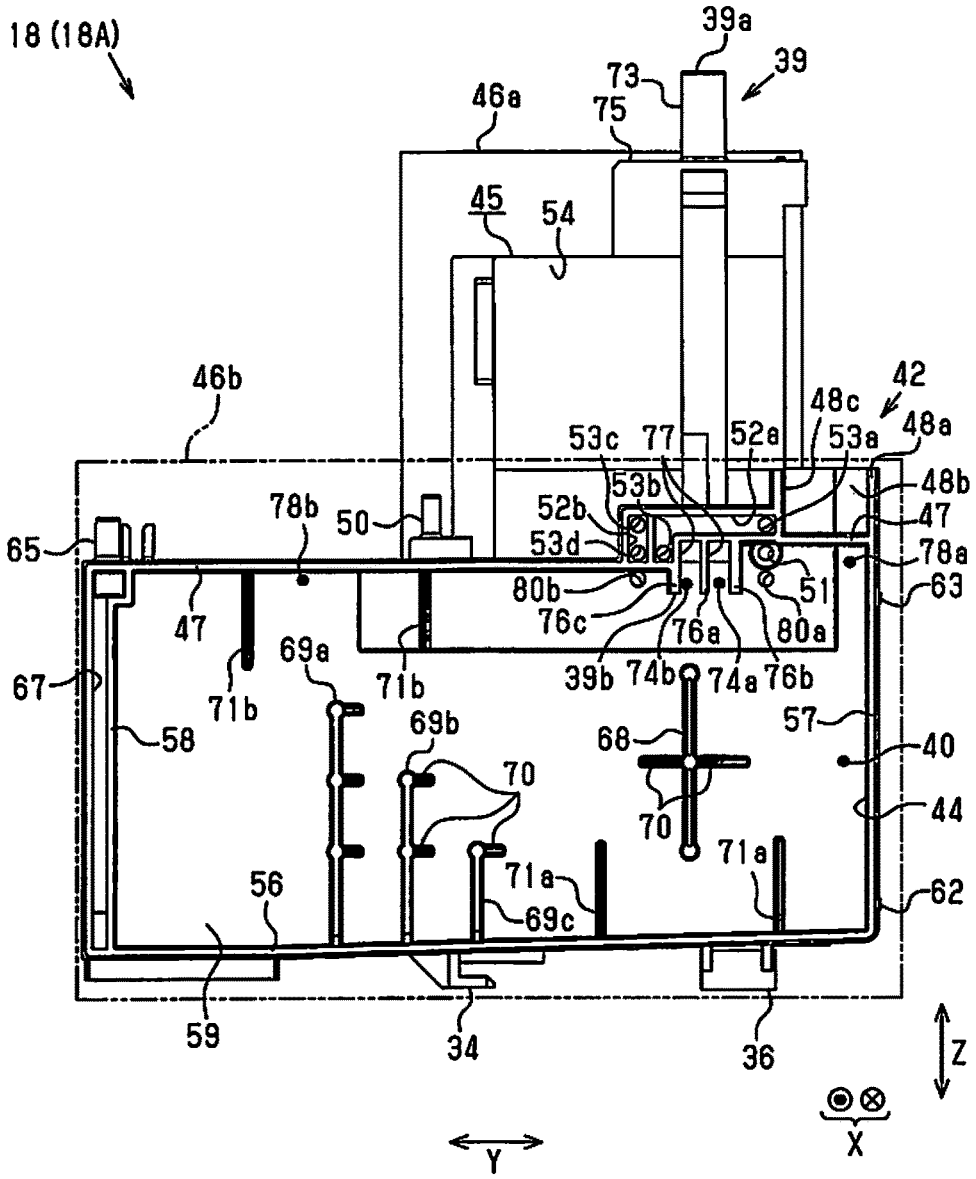
FIG. 7 is a left side view illustrating the first ink container.

As shown in FIG. 6 and FIG. 7, the first ink container 18A include a communication portion 51 that causes a lower end of the first buffer chamber 41*a* to communicate with an upper end of the ink chamber 40, and connecting portions 52*a* to 52*c* provided to connect the buffer chambers 41*a* to 41*c* such as to communicate with one another. The communication portion 51 is arranged to communicate with the ink chamber 40 at a position above the second end portion 39*b* of the ink inlet flow path portion 39 in the use state of the first ink container 18A.

The first connecting portion 52*a* is provided to connect the first buffer chamber 41*a* with the second buffer chamber 41*b*. The second connecting portion 52*b* is provided to connect the second buffer chamber 41*b* with the third buffer chamber 41*c*. The third connecting portion 52*c* is formed in a fine serpentine shape and is provided to connect the third buffer chamber 41*c* with the air communication portion 50.

More specifically, the first connecting portion 52*a* is arranged to connect a first through hole 53*a* formed above the communication portion 51 in a lower portion of the first buffer chamber 41*a* with a second through hole 53*b* formed at a lower end of the second buffer chamber 41*b*. The second connecting portion 52*b* is arranged to connect a third through hole 53*c* formed above the second through hole 53*b* in a lower portion of the second buffer chamber 41*b* with a fourth through hole 53*d* formed at a lower end of the third buffer chamber 41*c*.

The through holes 53*a* to 53*d* are formed to pass through a left wall 54 that is provided to define the buffer chambers 41*a* to 41*c*. The first connecting portion 52*a* and the second connecting portion 52*b* are provided on an outer face (left face) of the left wall 54 and are respectively formed by a groove that is open leftward and the second film 46*b* arranged to seal this groove. The third connecting portion 52*c* is formed by a groove that is open rightward and the first film 46*a* arranged to seal this groove.

Accordingly, the ink chamber 40 communicates with the air communication portion 50 via the communication portion 51, the first buffer chamber 41*a*, the first connecting portion 52*a*, the second buffer chamber 41*b*, the second connecting portion 52*b*, the third buffer chamber 41*c* and the third connecting portion 52*c*.

The following describes the ink chamber 40.

As shown in FIG. 5 and FIG. 7, the first ink container 18A includes the ceiling wall 47 arranged to define the ink chamber 40, a bottom wall 56 opposed to the ceiling wall 47 in the vertical direction Z, and a front wall 57, a rear wall 58 and a right wall 59 arranged to intersect with the ceiling wall 47 and the bottom wall 56. The front wall 57, the rear wall 58 and the right wall 59 form a side wall of the ink chamber 40. The side wall is accordingly provided to be extended in a direction intersecting with the ceiling wall 47 and is provided to stand in the vertical direction Z in the use state. The ceiling wall 47 of the ink chamber 40 is arranged to separate the ink chamber 40 from the buffer chambers 41*a* to 41*c*. Part of the right wall 59 and the front wall 57 are formed to be extended above the ink chamber 40, and the respective portions above the ceiling wall 47 serve as the first reservoir wall 48*a* and the second reservoir wall 48*b*.

As shown in FIG. 4, the container case 45 of the first ink container 18A is made of a transparent or translucent resin to allow a liquid level of the ink contained in the ink chamber 40 to be visible from outside. A region of the front wall 57 (one example of the side wall) corresponding to the window 21 of the housing 20 (shown in FIG. 1) serves as a visible surface 61 that causes the ink contained in the ink chamber 40 to be visually recognizable from outside. The visible surface 61 is provided with a lower limit indicator 62 that gives a rough indication for ink refill into the ink chamber 40 and an upper limit indicator 63 that gives a rough indication of an upper limit of the amount of ink refill. The visible surface 61 is provided along the vertical direction Z in the use state of the first ink container 18A. The reservoir portion 42 is located between the first end portion 39*a* of the ink inlet flow path portion 39 and the visible surface 61 in the depth direction Y and in the vertical direction Z.

The upper limit indicator 63 may not be necessarily provided in the first ink container 18A. For example, in the housing 20 of the printer 12, the window 21 opposed to the visible surface 61 may be formed from a transparent or translucent member as a wall that allows for transmission of light, and the upper limit indicator 63 may be provided in the window 21. Another modification may be provided without the upper limit indicator 63. When ink is filled up to the second end portion 39*b* during ink refill, the ink refill is automatically stopped. Accordingly, this configuration enables the ink refill to be completed without checking the upper limit indicator 63.

As shown in FIG. 5 and FIG. 7 the ceiling wall 47 is provided with an ink discharge portion 65 which the supply portion 24 (shown in FIG. 1) is connected to lead out the ink. The bottom wall 56 is formed to be inclined such that the front wall 57-side is made higher in the depth direction Y. A filter mounting structure 66 in a recessed shape is formed in the bottom wall 56 at a position on the rear wall 58-side that is the lower side of the inclination. The first ink container 18A is further provided with an ink discharge path 67 that is connected with the ink discharge portion 65 via a filter (not shown) placed in the filter mounting structure 66. The filter may be provided in the filter mounting structure 66 by, for example, thermal welding. When ink is consumed by the ink ejection head 25, the ink contained in the ink chamber 40 is supplied via the filter placed in the filter mounting structure 66 through the ink discharge path 67, the ink discharge portion 65 and the supply portion 24 to the printing assembly 23.

At least one (according to this embodiment, one) vertical rib 68 is formed at a position below the ink inlet flow path portion 39 in the ink chamber 40. The vertical rib 68 is formed to be away from the ceiling wall 47 and the bottom wall 56 across some gaps in the vertical direction Z. Additionally, at least one (according to this embodiment, three) intersecting rib, e.g., intersecting ribs 69*a* to 69*c* are provided at positions between the vertical rib 68 and the ink discharge portion 65 in the depth direction Y to intersect with the bottom wall 56. The intersecting ribs 69*a* to 69*c* are protruded upward from the bottom wall 56 to be away from each other in the depth direction Y. The intersecting ribs 69*a* to 69*c* are also provided to be extended along the width direction X.

The intersecting ribs 69*a* to 69*c* have different heights of upward projection from the bottom wall 56. More specifically, among the intersecting ribs 69*a* to 69*c*, the first intersecting rib 69*a* located on the ink discharge portion 65-side has a largest height of projection. Additionally, the height of projection of the second intersecting rib 69*b* is larger than the height of projection of the third intersecting rib 69*c*. In other words, the interval between the second intersecting rib 69*b* and the ceiling wall 47 is wider than the interval between the first intersecting rib 69*a* and the ceiling wall 47 and is narrower than the interval between the third intersecting rib 69*c* and the ceiling wall 47.

Protrusions 70 are formed in an approximately right triangular shape in the plan view such as to gradually increase the width in the depth direction Y from the opening side of the chamber recess 44 toward the right wall 59-side and are provided on both the front side and the rear side of the vertical rib 68 and on the front side of the respective intersecting ribs 69*a* to 69*c* to be perpendicular to the right wall 59.

The widths of the vertical rib 68 and the intersecting ribs 69*a* to 69*c* in the width direction X are approximately equal to the width of the chamber recess 44. Accordingly, when the second film 46*b* is bonded to the chamber recess 44, the second film 46*b* is also bonded to bonding surfaces on respective left ends of the vertical rib 68 and the intersecting ribs 69*a* to 69*c*. Lower ends of the respective intersecting ribs 69*a* to 69*c* are recessed from the respective bonding surfaces toward the right wall 59-side. Accordingly when the second film 46*b* is bonded to the intersecting ribs 69*a* to 69*c*, the recessed portions of the intersecting ribs 69*a* to 69*c* serve to cause regions on the respective sides of the intersecting ribs 69*a* to 69*c* in the depth direction Y to communicate with one another.

Additionally, first projections 71*a* are formed at positions on the respective sides of the vertical rib 68 in the depth direction Y to be protruded upward from the bottom wall 56.

Furthermore, second projections 71*b* are formed at positions between the vertical rib 68 and the ink discharge portion 65 to be protruded downward from the ceiling wall 47. The first projections 71*a* and the second projections 71*b* are formed in approximately right triangular shapes in the front view such as to gradually decrease the width in the vertical direction Z from the right wall 59 toward the opening (left side) of the chamber recess 44.

The following describes the ink inlet flow path portion 39.

As shown in FIG. 7, the second end portion 39*b* of the ink inlet flow path portion 39 is located in an upper space of the ink chamber 40 and is formed to be protruded downward from the ceiling wall 47 that is arranged to define the ink chamber 40. More specifically, in the use state of the first ink container 18A, the first end portion 39*a* of the ink inlet flow path portion 39 is located on the upper side of (according to this embodiment, vertically above) the second end portion 39*b*. The first end portion 39*a* is located on the upper side of the ceiling wall 47, and the second end portion 39*b* is located on the lower side of the ceiling wall 47. The upper space of the ink chamber 40 denotes a space on the upper side of the center of the ink chamber 40 and is a space located on the upper side of at least one of the upper end of the vertical rib 68, the upper end of the first intersecting rib 69*a* and the lower ends of the second projections 71*b*.

The ink inlet flow path portion 39 includes a tubular body 73 provided along the vertical direction Z and also includes at least one (according to this embodiment, a plurality of) ink flow path, e.g., a first ink flow path 74*a* and a second ink flow path 74*b* arranged to connect the first end portion 39*a* that is a leading end (upper end) of the tubular body 73 with the second end portion 39*b*. The tubular body 73 is provided to be protruded upward from an upper face 75 of the first ink container 18A that is arranged to intersect with the third reservoir wall 48*c*.

The second end portions 39*b* of the first ink flow path 74*a* and of the second ink flow path 74*b* are located at the same height in the ink chamber 40. The second end portion 39*b* of the ink inlet flow path portion 39 is located at a position corresponding to the upper limit indicator 63 in the vertical direction Z. More specifically, the second end portion 39*b* is located at the same height as that of the upper limit indicator 63 or in the vicinity of the upper limit indicator 63 in the vertical direction Z.

Figure 8:
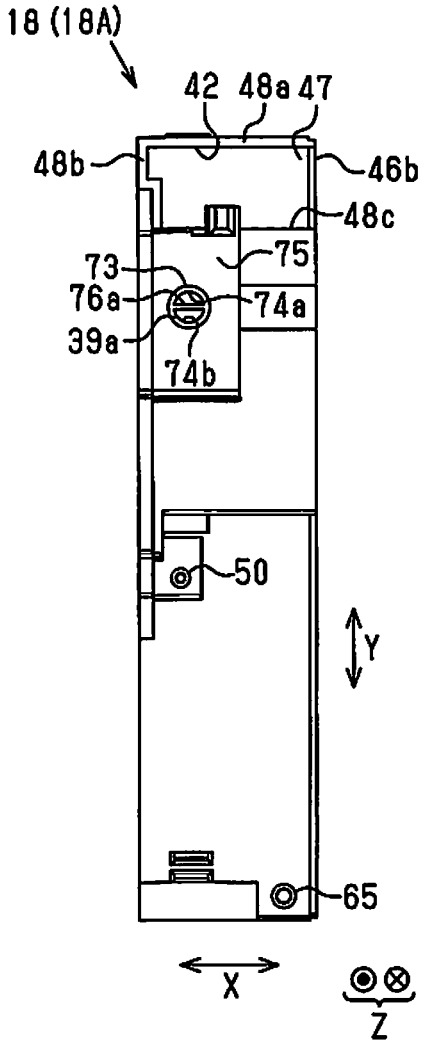
FIG. 8 is a plan view illustrating the first ink container.

As shown in FIG. 8, a first flow path wall 76*a* is provided at a center position in the depth direction Y in the cylindrical tubular body 73 to be arranged along the width direction X and the vertical direction Z. The first ink flow path 74*a* and the second ink flow path 74*b* have approximately the same sectional areas in the horizontal direction in the tubular body 73.

As shown in FIG. 6 and FIG. 7, the first flow path wall 76*a* arranged to separate the first ink flow path 74*a* and the second ink flow path 74*b* from each other is provided continuously from the first end portion 39*a* to the second end portion 39*b*. A second flow path wall 76*b* and a third flow path wall 76*c* are provided at positions on the respective sides of the first flow path wall 76*a* in the depth direction Y and are respectively configured to separate the first buffer chamber 41*a* from the ink inlet flow path portion 39 and configured to separate the second buffer chamber 41*b* from the ink inlet flow path portion 39. According to this embodiment, grooves 77 formed to be continuous with the tubular body 73 are defined by respective pairs of flow path walls (i.e., the pair of the first flow path wall 76*a* and the second flow path wall 76*b* and the pair of the first flow path wall 76*a* and the third flow path wall 76*c*). According to this embodiment, the two grooves 77 extended along the vertical direction Z are arrayed in the depth direction Y.

At least part of the ink inlet flow path portion 39 is configured by the flow path walls 76*a* to 76*c* and the first film 46*a* and the second film 46*b* attached to the flow path walls 76*a* to 76*c*. The grooves 77 are sealed with the first film 46*a* and the second film 46*b*. More specifically, the grooves 77 are formed to be open to the respective sides in the width direction X. The first film 46*a* is placed to seal part of the groove 77 that is a portion formed between the first buffer chamber 41*a* and the second buffer chamber 41*b*, so as to form part of the ink inlet flow path portion 39. The second film 46*b* is placed to seal part of the groove 77 that is a portion formed in the chamber recess 44, so as to form part of the ink inlet flow path portion 39 and the second end portion 39*b*.

As shown in FIG. 7, in the use state of the first ink chamber 18A, the upper space above the second end portion 39*b* in the ink chamber 40 is parted by the ink inlet flow path portion 39 into a first upper space 78*a* on the front side and a second upper space 78*b* on the rear side. In other words, the ink chamber 40 includes the first upper space 78*a* and the second upper space 78*b* that are provided across the ink inlet flow path portion 39.

As shown in FIG. 6 and FIG. 7, the first ink container 18A includes a communication path 79 arranged to cause the first upper space 78*a* and the second upper space 78*b* to communicate with each other. More specifically, the communication path 79 is arranged to cause a first connecting hole 80*a* and a second connecting hole 80*b* that are formed to pass through the right wall 59 of the ink chamber 40, to communicate with each other and is formed by a groove that is open rightward and the first film 46*a* that is provided to seal this groove. The first connecting hole 80*a* is open to the first upper space 78*a* which the communication portion 51 is open to, while the second connecting hole 80*b* is open to the second upper space 78*b* that is located on the opposite side to the first upper space 78*a* across the ink inlet flow path portion 39.

In the use state of the first ink container 18A, the volume of the upper space above the second end portion 39*b* in the ink chamber 40 is larger than the volume of the ink inlet flow path portion 39. Accordingly, the total volume of the first upper space 78*a* and the second upper space 78*b* is larger than the total volume of the first ink flow path 74*a* and the second ink flow path 74*b*.

Figure 9:
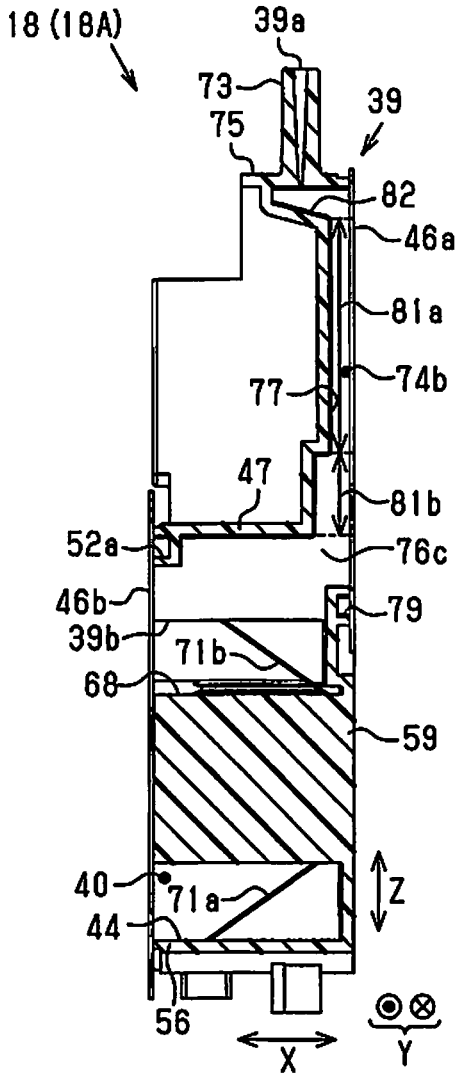
FIG. 9 is a sectional view taken along an arrow 9-9 in FIG. 6.

As shown in FIG. 9, the second ink flow path 74*b* includes a first flow path portion 81*a* and a second flow path portion 81*b* that has a larger sectional area in the horizontal direction than that of the first flow path portion 81*a*. In other words, at least one ink flow path among the plurality of ink flow paths is configured to include the first flow path portion 81*a* and the second flow path portion 81*b*. According to this embodiment, the first flow path portion 81*a* and the second flow path portion 81*b* have the grooves 77 of different depths. The depth of the groove 77 of the second flow path portion 81*b* is greater than the depth of the groove 77 of the first flow path portion 81*a*. In the vertical direction Z, the first flow path portion 81*a* is located above the second flow path portion 81*b*, and the first flow path portion 81*a* has a larger length than the length of the second flow path portion 81*b*.

As shown in FIG. 6, an upper end of the second flow path portion 81*b* is located above the reservoir walls 48*a* to 48*c* and is also located above the air communication portion 50 and the ink discharge portion 65. Additionally, the upper end of the second flow path portion 81*b* is located above the communication portion 51, the first connecting portion 52*a*, the second connecting portion 52*b* and the through holes 53*a* to 53*d* and is located below upper ends of the buffer chambers 41*a* to 41*c*.

Figure 10:
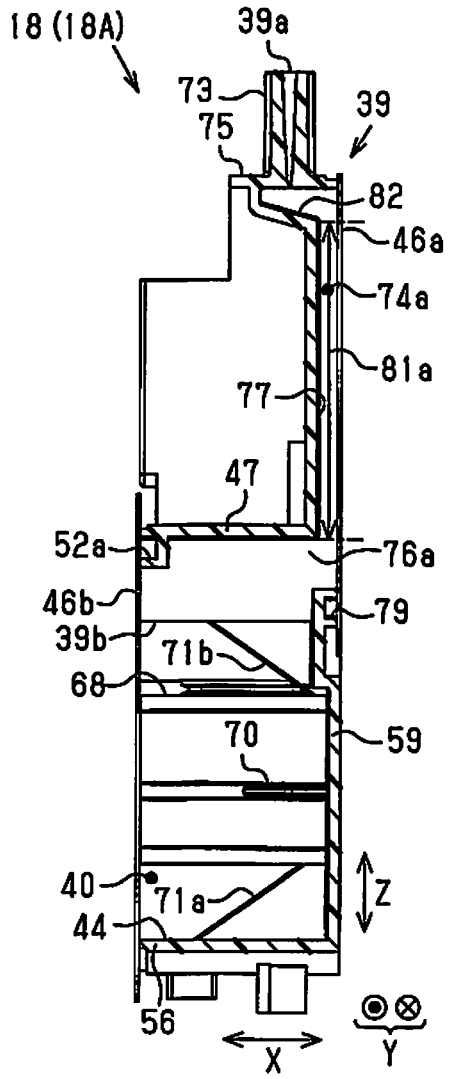
FIG. 10 is a sectional view taken along an arrow 10-10 in FIG. 6.

As shown in FIG. 9 and FIG. 10, the depth of a portion of the groove 77 of the first ink flow path 74*a* that is sealed with the first film 46*a* and is arranged corresponding to the first flow path portion 81*a* of the second ink flow path portion 74*b* is equal to the depth of a portion of the groove 77 of the first ink flow path 74*a* that is arranged corresponding to the second flow path portion 81*b* of the second ink flow path portion 74*b*. A portion of the first ink flow path 74*a* having an identical sectional area in the horizontal direction with the sectional area in the horizontal direction of the first flow path portion 81*a* of the second ink flow path 74*b* is a first flow path portion 81*a* of the first ink flow path 74*a*. In other words, a portion of the second ink flow path 74*b* having a different sectional area in the horizontal direction at the same height in the vertical direction Z from that of the first ink flow path 74*a* is the second flow path portion 81*b* of the second ink flow path 74*b*.

As shown in FIG. 9 and FIG. 10, portions of the first ink flow path 74*a* and the second ink flow path 74*b* above the respective first flow path portions 81*a* (on the side connecting with the tubular body 73) serve as an ink receiving portion 82 that is formed to have a larger sectional area in the horizontal direction than those of the first flow path portions 81*a*. The ink receiving portion 82 has a bottom face that is formed to be inclined downward, in order to cause ink to be readily introduced into the first flow path portions 81*a* that are continuous with the ink receiving portion 82.

The following describes the second ink container 18B.

Figure 11:
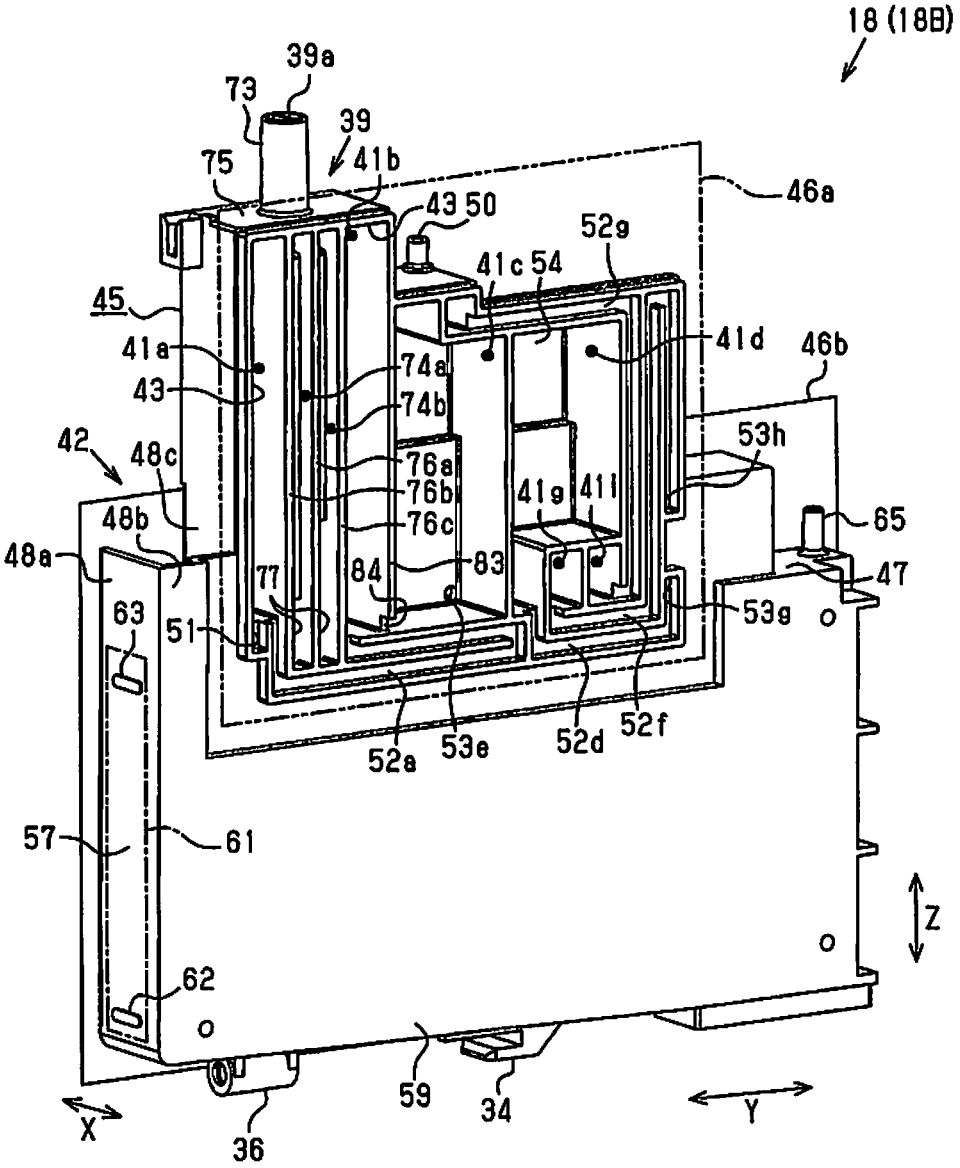
FIG. 11 is a perspective view illustrating a second ink container viewed from the right side.
Figure 12:
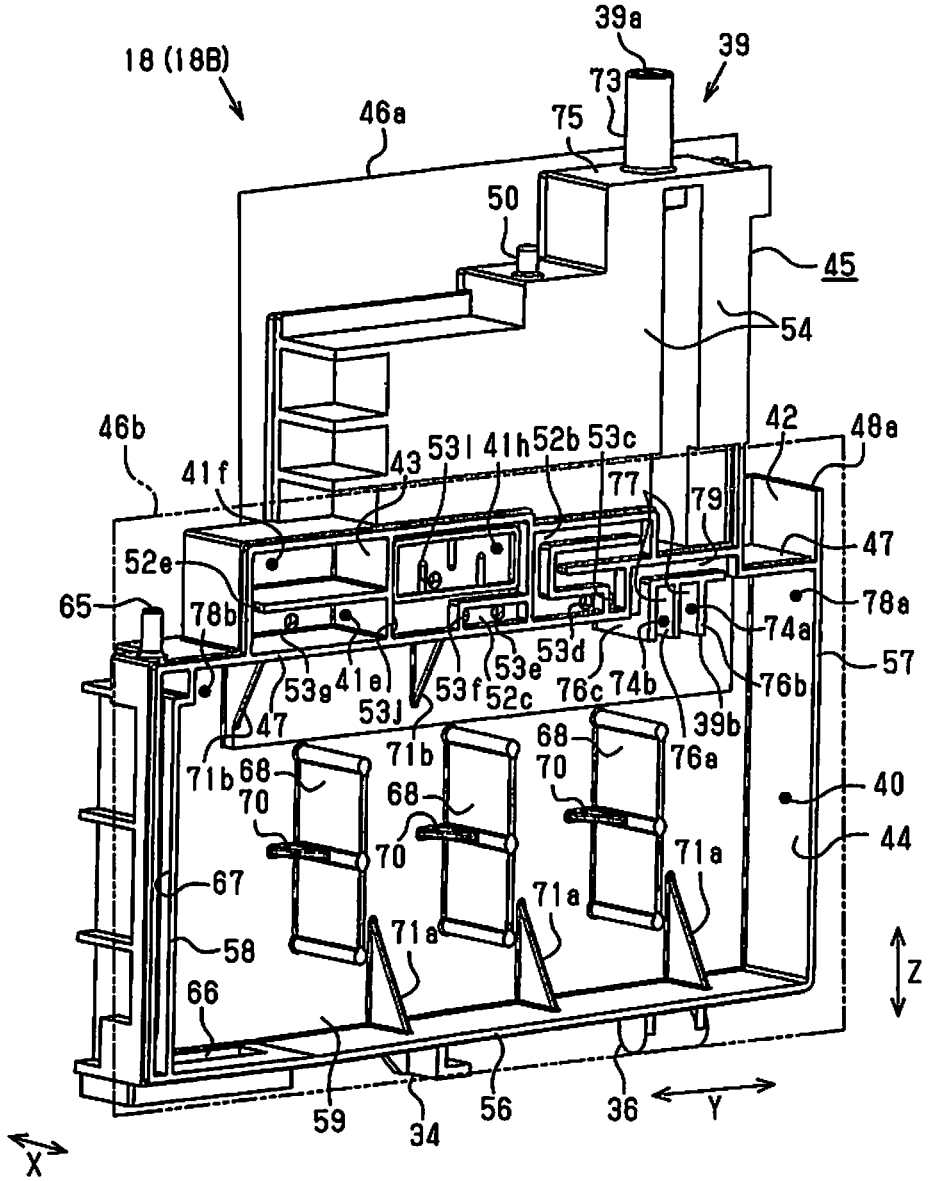
FIG. 12 is a perspective view illustrating the second ink container viewed from the left side.

As shown in FIG. 11 and FIG. 12, the second ink container 18B includes at least one (according to this embodiment, nine) buffer chamber, e.g., buffer chambers 41*a* to 41*i* and connecting portions 52*a* to 52*g* configured to connect the respective buffer chambers 41*a* to 41*i* with an air communication portion 50. The first to the fourth buffer chambers 41*a* to 41*d*, the seventh buffer chamber 41*g* and the ninth buffer chamber 41*i* are formed by sealing respective buffer recesses 43 that are open rightward with a first film 46*a*. The fifth buffer chamber 41*e*, the sixth buffer chamber 41*f* and the eighth buffer chamber 41*h* are formed by sealing respective buffer recesses 43 that are open leftward with a second film 46*b*. The air communication portion 50 is formed at a position above a ceiling wall 47 and above the third buffer chamber 41*c*.

The third connecting portion 52*c* is provided to connect the third buffer chamber 41*c* with the fourth buffer chamber 41*d*. The fourth connecting portion 52*d* is provided to connect the fourth buffer chamber 41*d* with the fifth buffer chamber 41*e*. The fifth connecting portion 52*e* is provided to connect the fifth buffer chamber 41*e* with the sixth buffer chamber 41*f*. The sixth connecting portion 52*f* is provided to connect the sixth buffer chamber 41*f* with the seventh buffer chamber 41*g*. The seventh connecting portion 52*g* is provided to connect the ninth buffer chamber 41*i* with the air communication portion 50.

Figure 13:
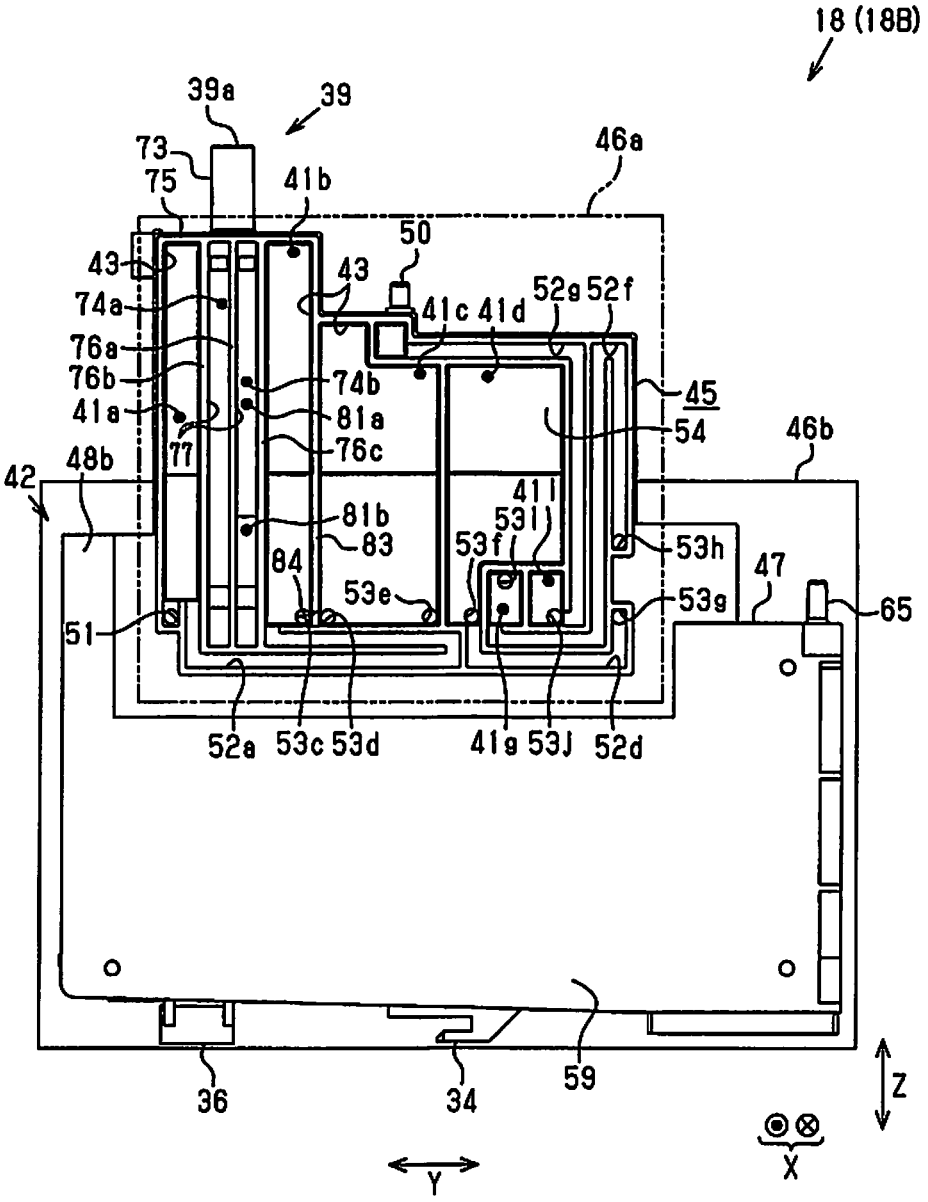
FIG. 13 is a right side view illustrating the second ink container.
Figure 14:
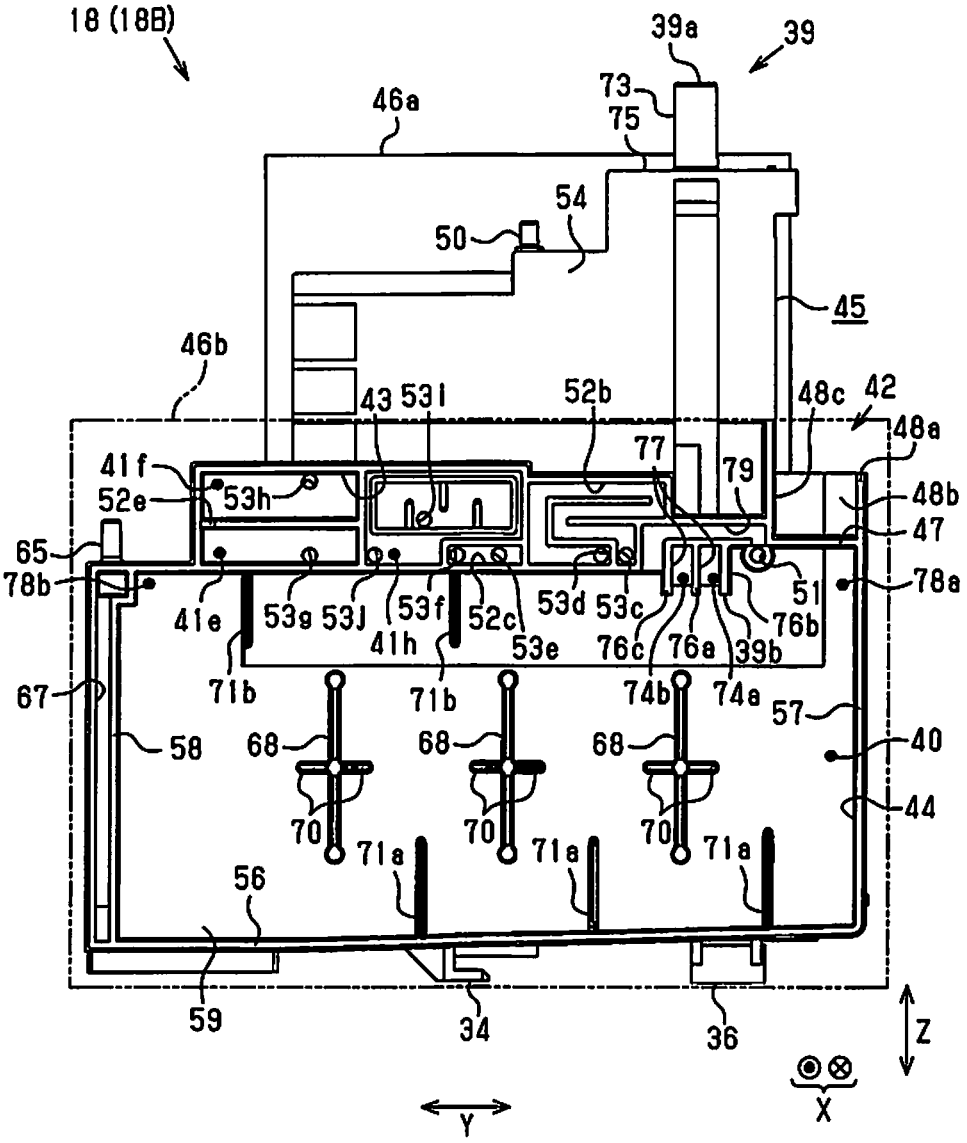
FIG. 14 is a left side view illustrating the second ink container.

As shown in FIG. 13 and FIG. 14, third to tenth through holes 53*c* to 53*j* are formed in a left wall 54. More specifically, the third through hole 53*c* is formed in the second buffer chamber 41*b*. The fourth through hole 53*d* and the fifth through hole 53*e* are formed in the third buffer chamber 41*c*. The sixth through hole 53*f* is formed in the fourth buffer chamber 41*d*. Additionally, the seventh through hole 53*g* is formed in the fifth buffer chamber 41*e*, and the eighth through hole 53*h* is formed in the sixth buffer chamber 41*f*. The eighth buffer chamber 41*h* is provided on the opposite side to the seventh buffer chamber 41*g* and the ninth buffer chamber 41*i* across the left wall 54. The ninth through hole 53*i* formed in the seventh buffer chamber 41*g* and the tenth through hole 53*j* formed in the ninth buffer chamber 41*i* are also open to the eighth buffer chamber 41*h*. A gas liquid separation film (not shown) that allows for transmission of the gas but prohibits transmission of ink is provided in the eighth buffer chamber 41*h*.

The first connecting portion 52*a*, the fourth connecting portion 52*d*, the sixth connecting portion 52*f* and the seventh connecting portion 52*g* are formed by grooves that are open rightward and the first film 46*a* placed to seal these grooves. The second connecting portion 52*b*, the third connecting portion 52*c* and the fifth connection portion 52*e* are formed by grooves that are open leftward and the second film 46*b* placed to seal these grooves.

A cutout 84 is formed at a lower end of a partition wall 83 that is provided to separate the second buffer chamber 41*b* and the third buffer chamber 41*c* from each other. Accordingly, in the state that the first film 46*a* is bonded to the partition wall 83, the second buffer chamber 41*b* and the third buffer chamber 41*c* communicate with each other by means of the second connecting portion 52*b* that is formed on the left wall 54-side and the cutout 84 that is formed in the partition wall 83.

The following describes the internal configuration of an ink chamber 40 in the second ink container 18B.

As shown in FIG. 12 and FIG. 14, a communication path 79 arranged to cause a first upper space 78*a* and a second upper space 78*b* of the ink chamber 40 to communicate with each other is provided to connect an upper end of the first upper space 78*a* with an upper end of the second upper space 78*b* and is formed by sealing a groove that is open leftward with the second film 46*b*.

The following describes the functions when the ink bottle 31 is connected with the ink inlet flow path portion 39 to supply the ink contained in the ink bottle 31 into the ink chamber 40. The functions in the course of ink refill for the second ink container 18B are identical with the functions in the course of ink refill for the first ink container 18A.

As shown in FIG. 6, when the ink bottle 31 is connected with the tubular body 73 on the first end portion 39*a*-side of the ink inlet flow path portion 39, ink flows down through the first ink flow path 74*a* and the second ink flow path 74*b* toward the ink chamber 40. The air inside of the ink chamber 40 is pressed by the ink to have an increased pressure.

The ink flowing through the first ink flow path 74*a* flows into the ink chamber 40. The ink flowing through the second ink flow path 74*b* is, on the other hand, pressed to stop the downflow at a position in the middle of the second ink flow path 74*b* by the internal air pressure of the ink chamber 40. The ink in the second ink flow path 74*b* is then pressed back to the ink bottle 31 by the internal air pressure of the ink chamber 40 which the ink flows into. For example, the ink flowing through the second ink flow path 74*b* may flow down through the first flow path portion 81*a* but may stop the downflow at a boundary between the first flow path portion 81*a* and the second flow path portion 81*b* and may be pressed back through the first flow path portion 81*a*.

The first ink flow path 74*a* accordingly serves as a flow path through which ink flows from the ink bottle 31 into the ink chamber 40, while the second ink flow path 74*b* serves as a flow path through which the air inside of the ink chamber 40 flows into the ink bottle 31. This configuration achieves so-called gas-liquid exchange between the ink bottle 31 and the ink container 18 that causes the air inside of the ink chamber 40 to be flowed into the ink bottle 31 by an amount corresponding to the amount of ink injected from the ink bottle 31 into the ink chamber 40.

When the liquid level of ink rises to the second end portion 39*b* and the second end portion 39*b* of the second ink flow path 74*b* is blocked by the ink, no more air is flowed into the ink bottle 31 through the second ink flow path 74*b*. This decreases the pressure applied to the liquid surface of ink in the ink bottle 31 and stops the inflow of ink from the ink bottle 31 into the ink chamber 40.

When the ink bottle 31 is disconnected from the ink inlet flow path portion 39, the atmospheric pressure is applied to the ink in the first ink flow path 74*a*. Accordingly, the ink in the first ink flow path 74*a* flows into the ink chamber 40, so that the liquid level of ink in the ink inlet flow path portion 39 is made equal to the liquid level of ink in the ink chamber 40.

The configuration of the first embodiment described above has the following advantageous effects.

(1) At least part of the ink inlet flow path portion 39 is formed by sealing the grooves 77 with the first film 46*a* and the second film 46*b*. The thickness of the ink inlet flow path portion 39 may thus be regulated by specifying the depths and the widths of the grooves 77. This configuration enables the long thin ink inlet flow path portion 39 having the gas liquid exchange capability to be readily manufactured.

(2) The ink inlet flow path portion 39 includes the plurality of ink flow paths 74*a* and 74*b*, and at least one ink flow path may serve a flow path for discharging the air. This configuration enables the ink flow path serving to flow ink into the ink chamber 40 to be separated from the flow path serving to discharge the air from the ink chamber 40 and thereby ensures stable supply of ink into the ink chamber 40.

(3) For example, in the process of flowing ink into the ink chamber 40, the pressure of ink against the air and the pressure of the air against ink may be balanced out in the plurality of ink flow paths 74*a* and 74*b*. This may cause accumulation of ink in these ink flow paths 74*a* and 74*b* and interfere with the inflow of ink into the ink chamber 40. The second ink flow path 74*b* is, however, configured to include the first flow path portion 81*a* of the smaller sectional area and the second flow path portion 81*b* of the larger sectional area. This configuration disturbs the balance of pressure between the air and the ink. This facilitates division of the functions of the plurality of ink flow paths 74*a* and 74*b* as the flow path for the air discharge and the flow path for the ink inflow.

(4) The plurality of ink flow paths 74*a* and 74*b* have the second end portions 39*b* at the same height. This configuration facilitates manufacture of the ink inlet flow path portion 39, compared with a configuration that the second end portions 39*b* are provided at different heights.

(5) Ink is accumulated in the lower portion of the ink chamber 40, and the air is accumulated in the upper space in the ink chamber 40. The configuration that the ink inlet flow path portion 39 is protruded from the ceiling wall 47 and that the second end portion 39*b* is located in the upper space of the ink chamber 40 enables the air inside of the ink chamber 40 to be readily discharged through the ink inlet flow path portion 39.

(6) In the process of ink refill into the ink chamber 40, the inflow of ink raises the liquid level of the ink contained in the ink chamber 40. When the liquid level reaches the upper limit indicator 63, the second end portion 39*b* of the ink inlet flow path portion 39 is blocked by the ink, and no more air is flowed from the second end portion 39*b* into the ink inlet flow path portion 39. This configuration accordingly enables the ink refill into the ink chamber 40 to be stopped at a position corresponding to the upper limit indicator 63.

(7) The first buffer chamber 41*a* and the second buffer chamber 41*b* are provided along the ink inlet flow path portion 39, so as to reinforce the ink inlet flow path portion 39. This configuration reduces the possibility of damage of the ink inlet flow path portion 39.

(8) For example, when the ink chamber 40 is sealed, the air is likely to be expanded by the effect of, for example, a temperature change, so as to press the liquid surface of ink and press the ink out of the ink chamber 40. The buffer chambers 41*a* to 41*i* are, however, configured to communicate with the outside air by the air communication portion 50. The ink chamber 40 and the first buffer chamber 41*a* are arranged to communicate with each other by the communication portion 51 that is open at a position above the second end portion 39*b*. This configuration reduces the possibility that ink is pressed out of the ink chamber 40 even when the ink is contained up to the height of the second end portion 39*b* in the ink chamber 40.

(9) In the configuration that the upper space in the ink chamber 40 is parted into the first upper space 78*a* and the second upper space 78*b* by the ink inlet flow path portion 39, the communication path 79 causes the first upper space 78*a* and the second upper space 78*b* to communicate with each other and to further communicate with the first buffer chamber 41*a*.

(10) In the process of ink refill into the ink chamber 40 by connection of the ink bottle 31 configured to contain ink for refill therein with the ink inlet flow path portion 39, when the second end portion 39*b* of the ink inlet flow path portion 39 is blocked by the ink to interfere with the introduction of the air from the second end portion 39*b*, the ink refill from the ink bottle 31 into the ink chamber 40 is stopped. Disconnection of the ink bottle 31 from the ink inlet flow path portion 39 causes the atmospheric pressure to be applied to the ink remaining in the ink inlet flow path portion 39 and thereby causes the remaining ink to be flowed into the ink chamber 40. The volume of the upper space of the ink chamber 40 is made larger than the volume of the ink inlet flow path portion 39. This configuration accordingly reduces the possibility that the ink flows into the first buffer chamber 41*a* even when the ink remaining in the ink inlet flow path portion 39 is flowed into the ink chamber 40.

(11) The buffer recesses 43 and the grooves 77 are sealed with the first film 46*a*, so as to form the buffer chambers 41*a* to 41*c* (the buffer chambers 41*a* to 41*d*, 41*g* and 41*h* in the second ink container 18B) and the ink inlet flow path portion 39. This configuration facilitates manufacture of the ink container 18.

(12) The chamber recess 44 and the grooves 77 are sealed with the second film 46*b*, so as to form the ink chamber 40 and the second end portion 39*b* of the ink inlet flow path portion 39. This configuration facilitates manufacture of the ink container 18.

(13) The ink spilled out of the ink inlet flow path portion 39 is accumulated in the reservoir portion 42. This configuration reduces the possibility that ink is spread over the periphery of the ink container 18. This reservoir portion 42 is readily formed by using the second film 46*b* provided to seal the ink inlet flow path portion 39.

(14) The first end portion 39*a* is located above the display unit 16. This configuration facilitates the refill operation for injecting ink from the first end portion 39*a* into the ink inlet flow path portion 39, compared with a configuration that the first end portion 39*a* and the display unit 16 are located at the same height or a configuration that the first end portion 39*a* is located below the display unit 16.

(15) The configuration that the first ink flow path 74*a* and the second ink flow path 74*b* are arrayed side by side increases the strength of the ink inlet flow path portion 39, compared with a configuration that the first ink flow path 74*a* and the second ink flow path 74*b* are formed to be away from each other.

(16) The ink inlet flow path portion 39 is formed to be protruded from the ceiling wall 47 of the ink chamber 40. This configuration forms a space between the second end portion 39*b* and the ceiling wall 47 in the ink chamber 40.

(17) The first buffer chamber 41*a* and the second buffer chamber 41*b* are provided along the ink inlet flow path portion 39 and may thus be formed by effectively using the lateral spaces of the ink inlet flow path portion 39. Providing the buffer chambers 41*a* to 41*i* enables the ink flowing out of the ink chamber 40 to be accumulated in the buffer chambers 41*a* to 41*i*. This configuration accordingly reduces the possibility of leakage of ink out of the ink container 18.

(18) In the second ink container 18B, the cutout 84 is provided on a different plane from that of the second connecting portion 52*b* arranged to connect the second buffer chamber 41*b* with the third buffer chamber 41*c*. This configuration enables ink to be readily flowed back to the second buffer chamber 41*b* even when the ink flows into the third buffer chamber 41*c*.

Second Embodiment

The following describes a second embodiment of a printer with reference to drawings. The configuration of the second embodiment differs from the configuration of the first embodiment by the shape of part of an ink container 18, but is otherwise similar to the configuration of the first embodiment. The like components are expressed by the like reference signs, for the purpose of omitting duplicated description.

Figure 15:
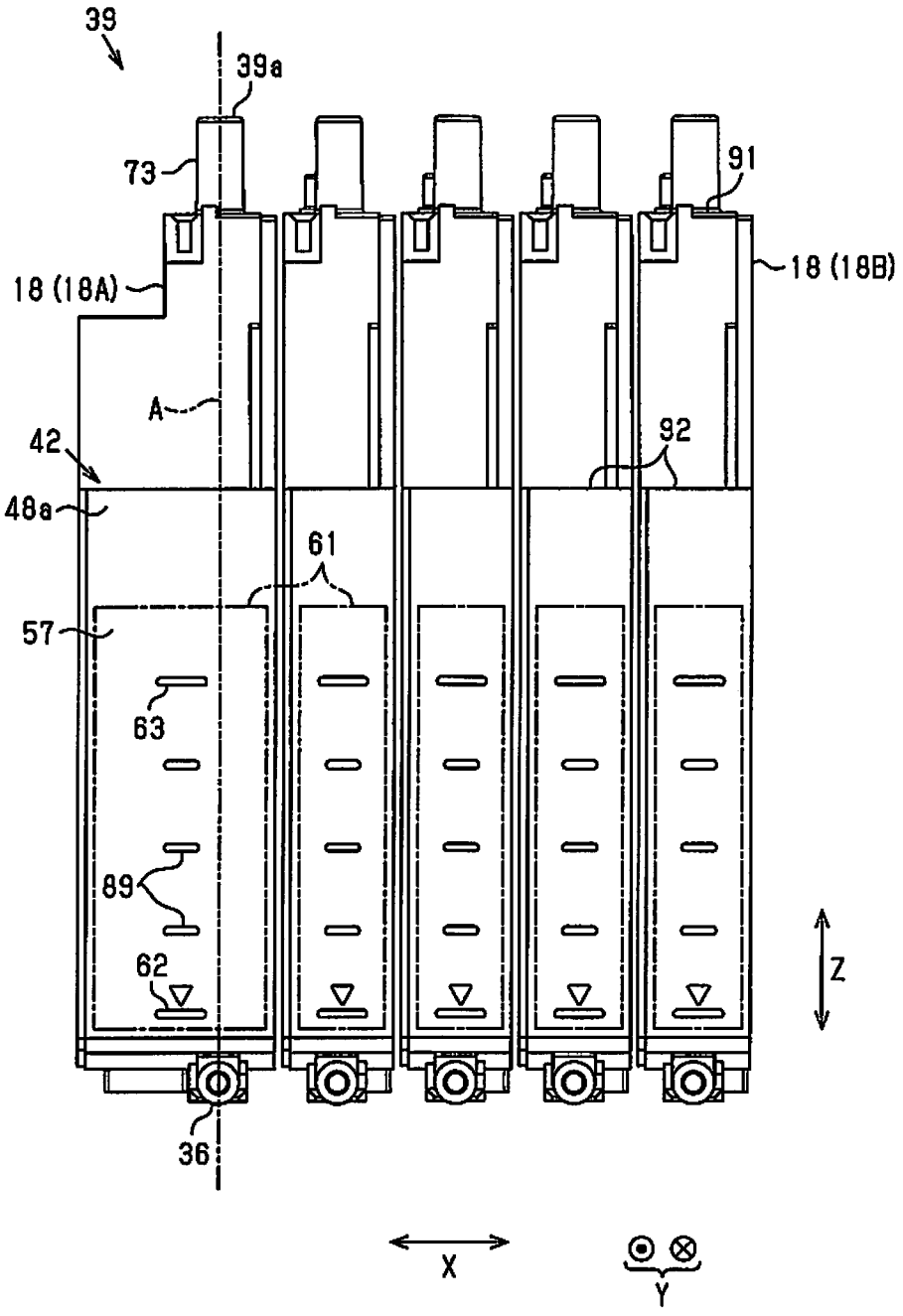
FIG. 15 is a front view illustrating ink containers provided in a printer according to a second embodiment.

As shown in FIG. 15, a first ink container 18A and a second ink container 18B have visible surfaces 61 that are visible through the windows 21 (shown in FIG. 1). A front wall 57 that is one example of the second wall is provided to define an ink chamber 40 and serves as a visible wall that enables ink contained in the ink chamber 40 to be visible from outside of the ink chamber 40.

At least one (three in FIG. 15) scale 89 is provided between a lower limit indicator 62 and an upper limit indicator 63 on the visible surface 61. When a plurality of scales 89 are provided, it is preferable to provide the scales 89, the lower limit indicator 62 and the upper limit indicator 63 at equal intervals. It is also preferable that the lower limit indicator 62, the upper limit indicator 63 and the scales 89 provided in the first ink container 18A are formed to be deviated from a center line A that passes through the center of a tubular body 73 in the width direction X. The center line A also passes through the center of a screwed element 36.

An inner surface of the front wall 57 on the ink chamber 40-side is subjected to a hydrophobic treatment. For example, the inner surface of the front wall 57 is coated with a silicone water repellent. This causes the ink adhering to the front wall 57 to be drawn back and enables the liquid level of the ink contained in the ink chamber 40 to be readily checked visually.

Figure 16:
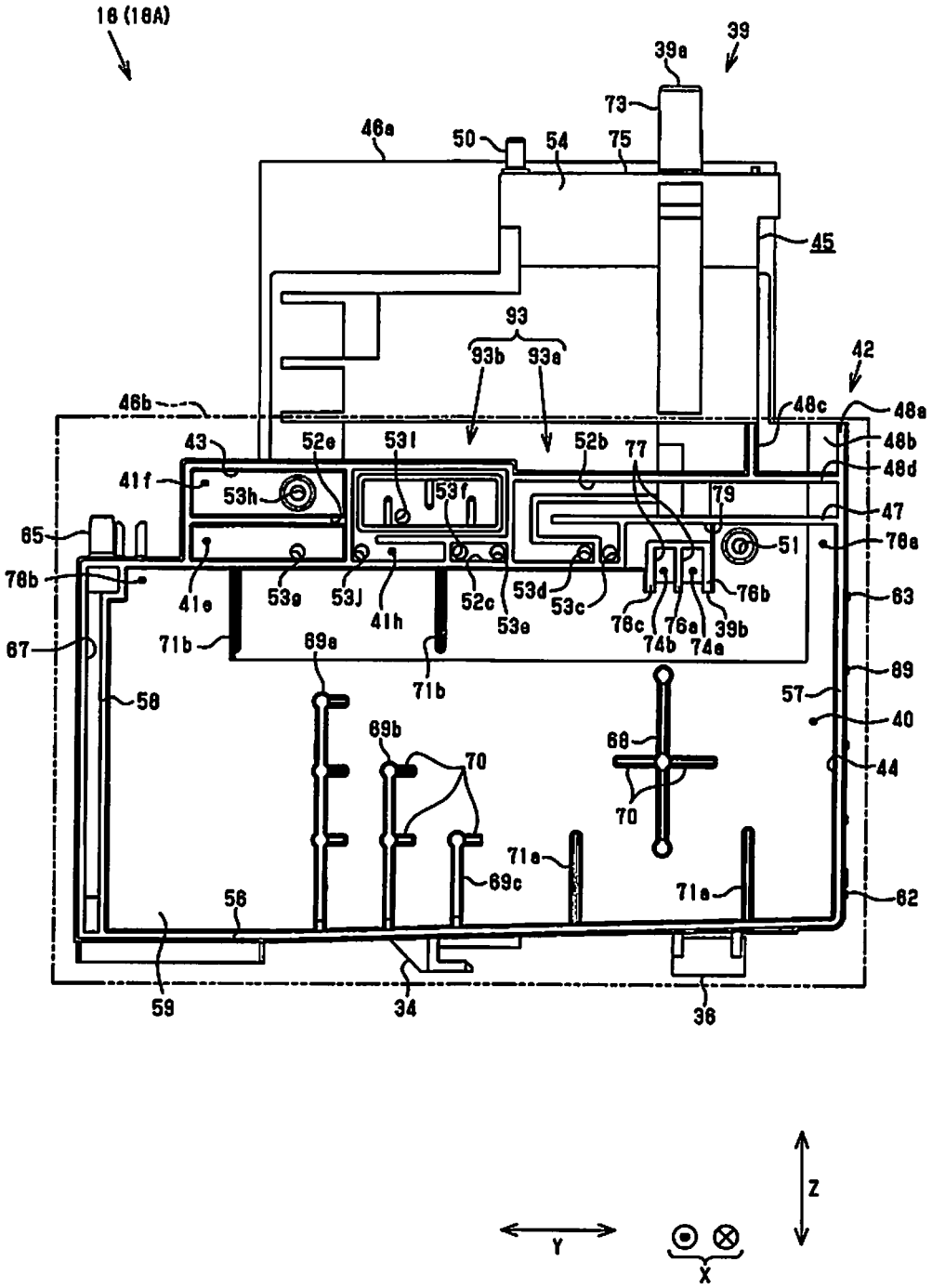
FIG. 16 is a left side view illustrating a first ink container.
Figure 17:
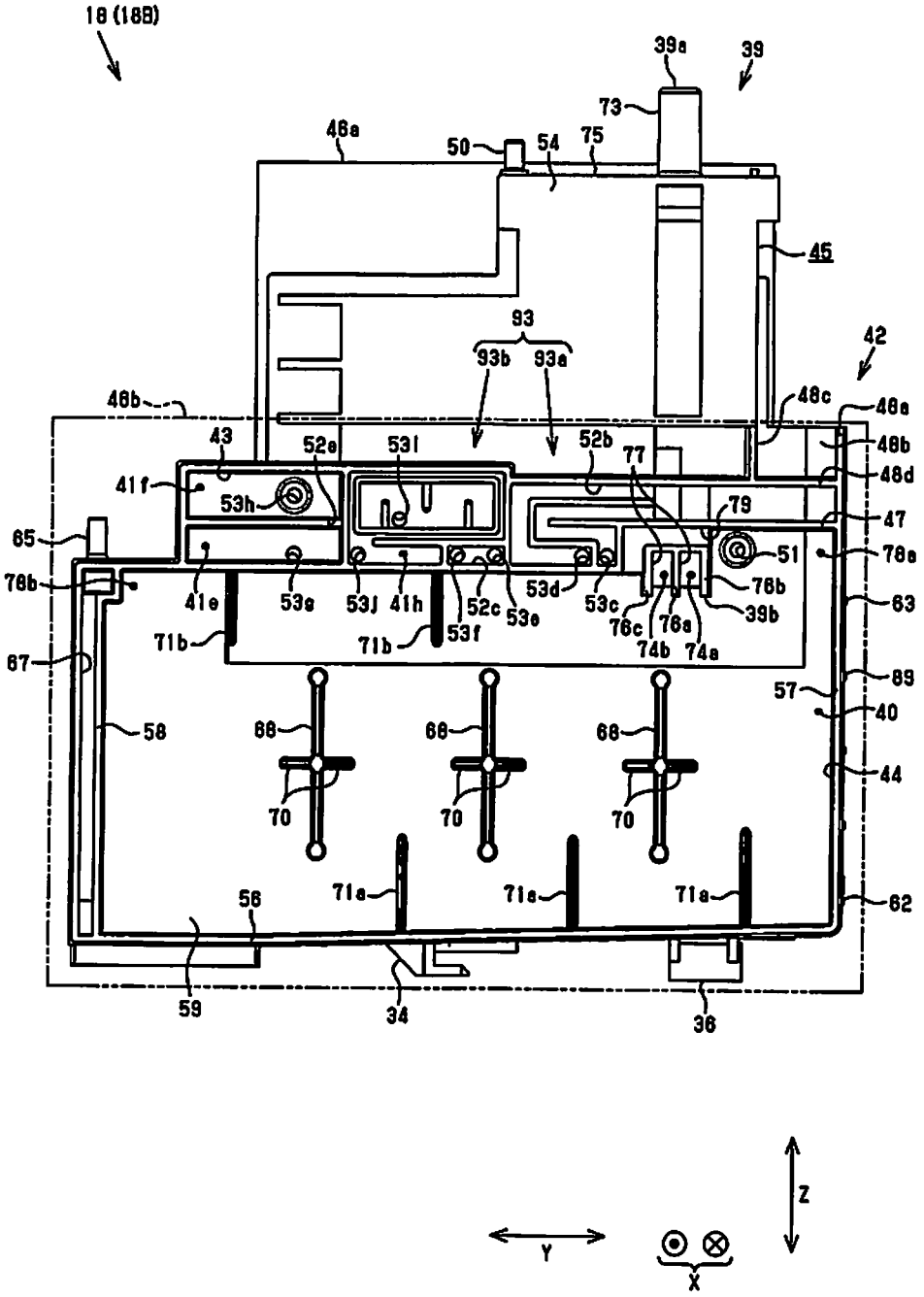
FIG. 17 is a left side view illustrating a second ink container.

As shown in FIG. 16 and FIG. 17, a communication portion 51 is formed in a tubular shape in the ink chamber 40. Additionally, the tubular communication portion 51 is preferably formed at a position away from a ceiling wall 47 and a second flow path wall 76*b*. This configuration reduces the possibility that ink flows along the edges of the ceiling wall 47 and the second flow path wall 76*b* into the communication portion 51.

An eighth through hole 53*h* is formed in a tubular shape in a sixth buffer chamber 41*f*. Additionally, the tubular eighth through hole 53*h* is preferably formed to be away from the wall of the sixth buffer chamber 41*f*. This configuration reduces the possibility that ink flows along the edge of the wall of the sixth buffer chamber 41*f* into the eighth through hole 53*h*.

Figure 18:
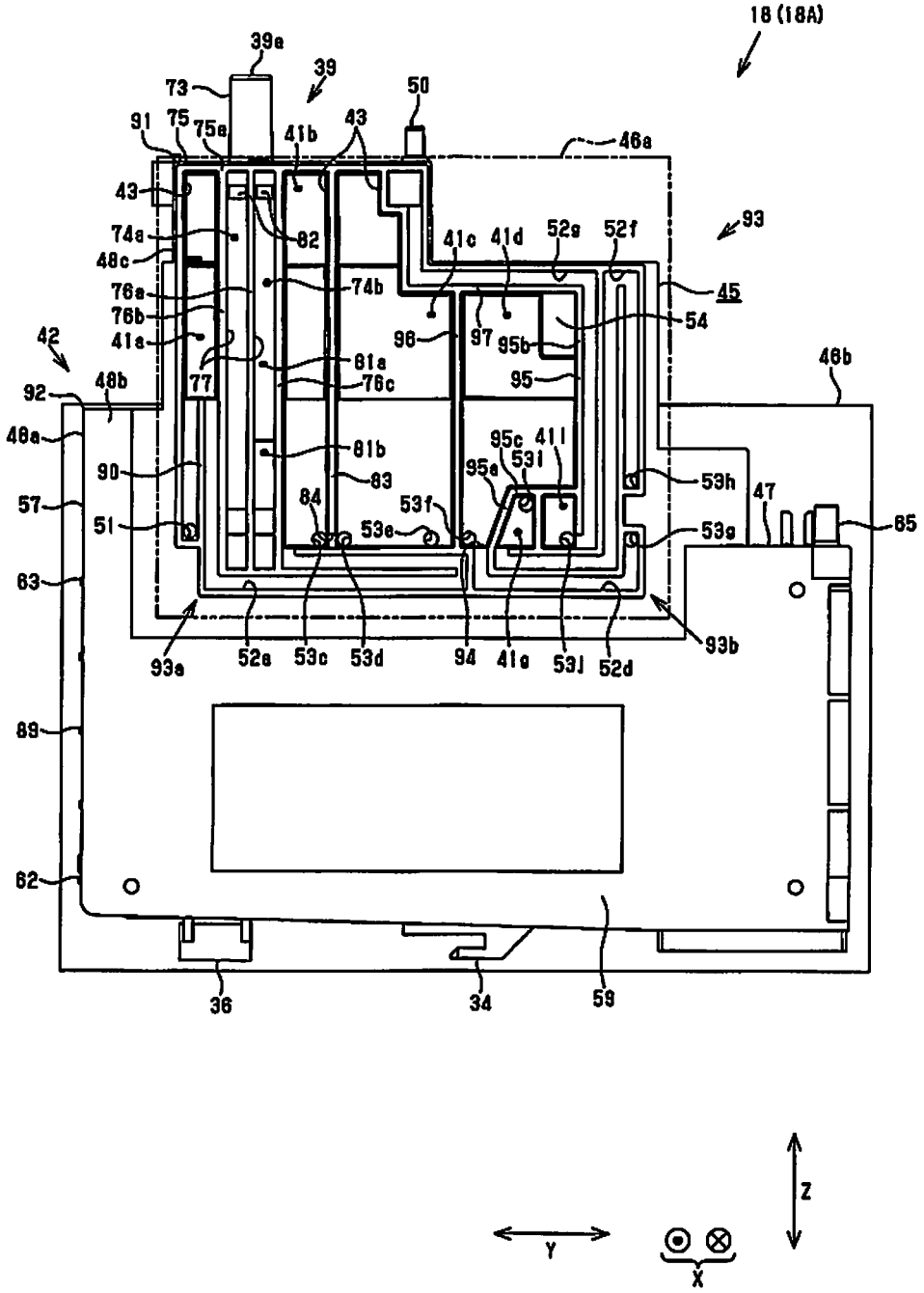
FIG. 18 is a right side view illustrating the first ink container.
Figure 19:
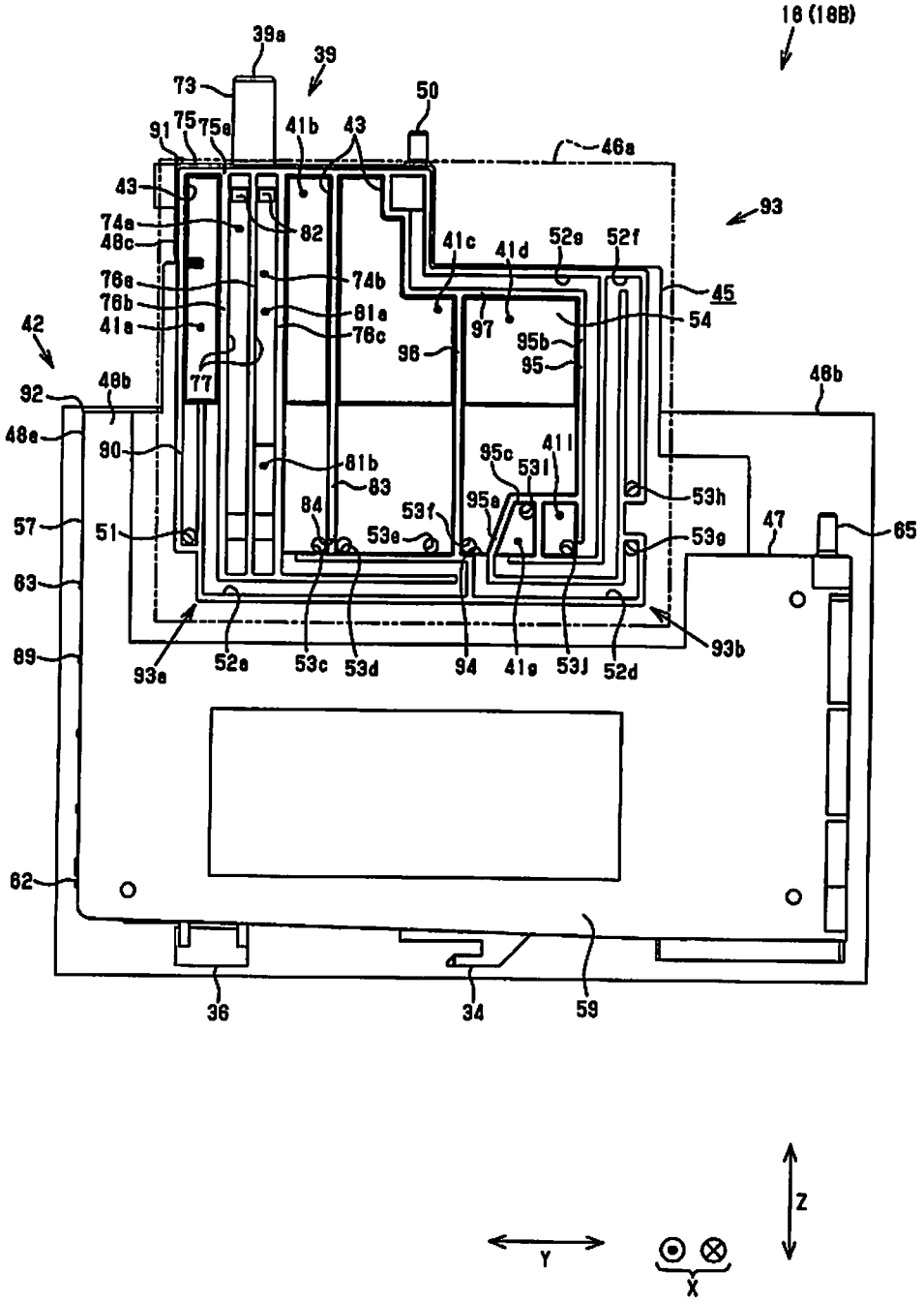
FIG. 19 is a right side view illustrating the second ink container.

As shown in FIG. 18 and FIG. 19, a partition wall 90 is provided in a first buffer chamber 41*a* to separate the communication portion 51 from a first connecting portion 52*a*. The partition wall 90 is formed in the first buffer chamber 41*a* to be extended upward from a lower end where the communication portion 51 is formed. An upper end of the partition wall 90 is located below an upper end of the first buffer chamber 41*a*. This configuration enables part of the first buffer chamber 41*a* to serve as a flow path continuous with the communication portion 51 and makes it unlikely to cause gas liquid exchange due to the vibration.

The tubular body 73 includes an opening (fill port) through which ink is injectable into the ink chamber 40 and is formed in a tubular body-forming wall 75*a* that is one example of the first wall to define an upper end of the ink container 18. Additionally, the tubular body-forming wall 75*a* is provided with an air communication portion 50 that causes the inside of the ink chamber 40 to communicate with the outside air.

It is preferable that the air communication portion 50 and the tubular body 73 are protruded from the tubular body-forming wall 75*a* in the same direction (upward direction). The configuration that the air communication portion 50 and the tubular body 73 are formed in the tubular body-forming wall 75*a* enables an aeration test to be readily performed by closing one of the tubular body 73 and the air communication portion 50 and flowing the air from the other. This aeration test is performed to check for any leakage in the ink chamber 40, an air communication path 93 provided to connect the ink chamber 40 with the air communication portion 50 and the like.

Figure 20:
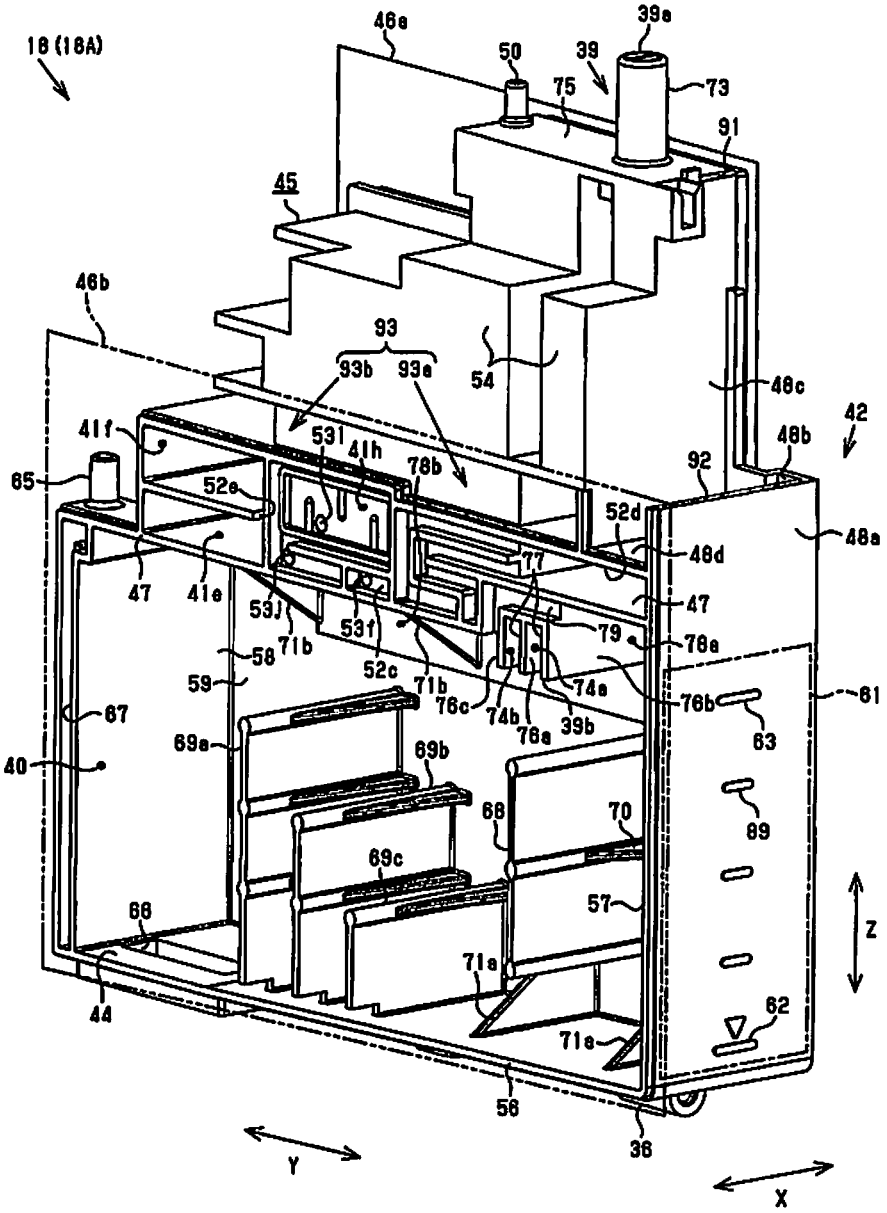
FIG. 20 is a perspective view illustrating the first ink container viewed from the left side.
Figure 21:
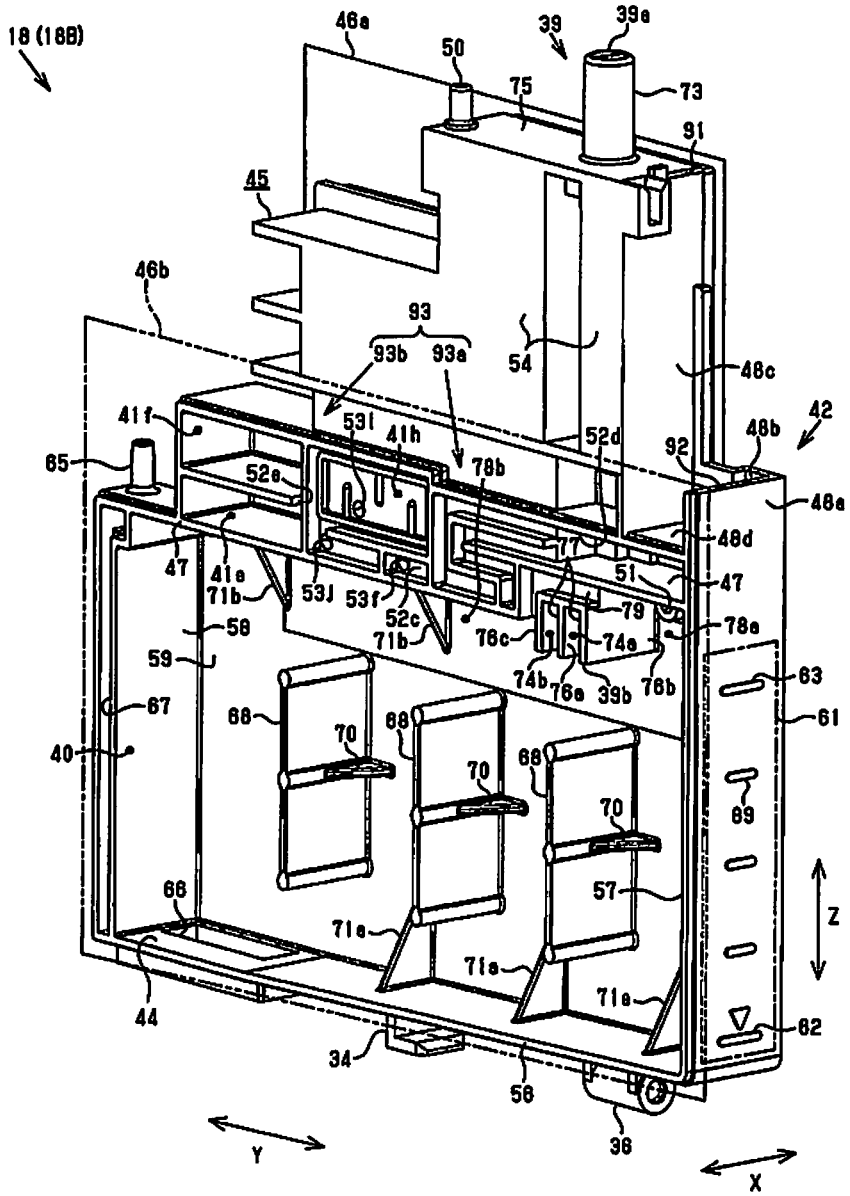
FIG. 21 is a perspective view illustrating the second ink container viewed from the left side.

As shown in FIG. 20 and FIG. 21, a reservoir portion 42 is defined by a reservoir bottom wall 48*d* provided above the ceiling wall 47, first to third reservoir walls 48*a* to 48*c* provided to stand upward from the reservoir bottom wall 48*d* and a second film 46*b*. The reservoir bottom wall 48*d* is provided to separate the reservoir portion 42 from a second connecting portion 52*b*.

A plurality of (according to this embodiment, two) corner portions, e.g., a first corner portion 91 and a second corner portion 92 are provided between the front wall 57 and the tubular body-forming wall 75*a*. In other words, the tubular body-forming wall 75*a* and the front wall 57 are connected with each other via the first corner portion 91 and the second corner portion 92.

More specifically, the front wall 57 is provided along the vertical direction Z to define a front end of the ink container 18. The tubular body-forming wall 75*a* is provided along the depth direction Y that intersects with the vertical direction Z. The front wall 57 is located on the front side and on the lower side of the tubular body-forming wall 75*a*, and the tubular body-forming wall 75*a* is located on the rear side and on the upper side of the front wall 57. In other words, an upper end of the front wall 57 on the tubular body-forming wall 75*a*-side is located on the lower side of the tubular body-forming wall 75*a*, and a front end of the tubular body-forming wall 75*a* on the front wall 57-side is located on the rear side of the front wall 57.

A front end of the tubular body-forming wall 75*a* forms the first corner portion 91, and an upper end of the front wall 57 forms the second corner portion 92. Accordingly, the first corner portion 91 is provided at a corner between the tubular body-forming wall 75*a* and the third reservoir wall 48*c*, and the second corner portion 92 is provided at a corner of the reservoir portion 42. The first corner portion 91 and the second corner portion 92 are located at different positions in the depth direction Y and in the vertical direction Z.

As shown in FIGS. 16 to 19, the ink container 18 includes an air communication path 93 that is arranged to cause the ink chamber to communicate with the outside air. According to this embodiment, the air communication path 93 is configured by the communication portion 51, first to ninth buffer chambers 41*a* to 41*i*, first to seventh connecting portion 52*a* to 52*g*, third to tenth through holes 53*c* to 53*j*, a cutout 84 and the air communication portion 50.

The fourth buffer chamber 41*d* is provided in the middle of the air communication path 93. The air communication path 93 includes a first air communication path 93*a* that is provided on the ink chamber 40-side of the fourth buffer chamber 41*d*, and a second air communication path 93*b* that is provided on the outside air-side of the fourth buffer chamber 41*d*. The fourth buffer chamber 41*d* is defined by a left wall 54, a lower wall 94, a rear side wall 95, a front side wall 96, an upper wall 97 and the first film 46*a*.

The first air communication path 93*a* is configured by the communication portion 51, the first to the third buffer chambers 41*a* to 41*c*, the first to the third connecting portions 52*a* to 52*c*, the third to the sixth through holes 53*c* to 53*f*, and the cutout 84. The first air communication path 93*a* is connected with the fourth buffer chamber 41*d* by the sixth through hole 53*f* that is one example of the connection port with the fourth buffer chamber 41*d*. Accordingly, the first air communication path 93*a* is connected at a position nearer to the front side wall 96 and nearer to the lower wall 94 in the left wall 54 of the fourth buffer chamber 41*d*.

The second air communication path 93*b* is configured by the fifth to the ninth buffer chambers 41*e* to 41*i*, the fourth to the seventh connecting portions 52*d* to 52*g*, the seventh to the tenth through holes 53*g* to 53*j*, and the air communication portion 50. The second air communication path 93*b* is connected with the lower wall 94 at a position nearer to the rear side wall 95 that is further away from the front side wall 96 than the sixth through hole 53*f*.

Figure 22:
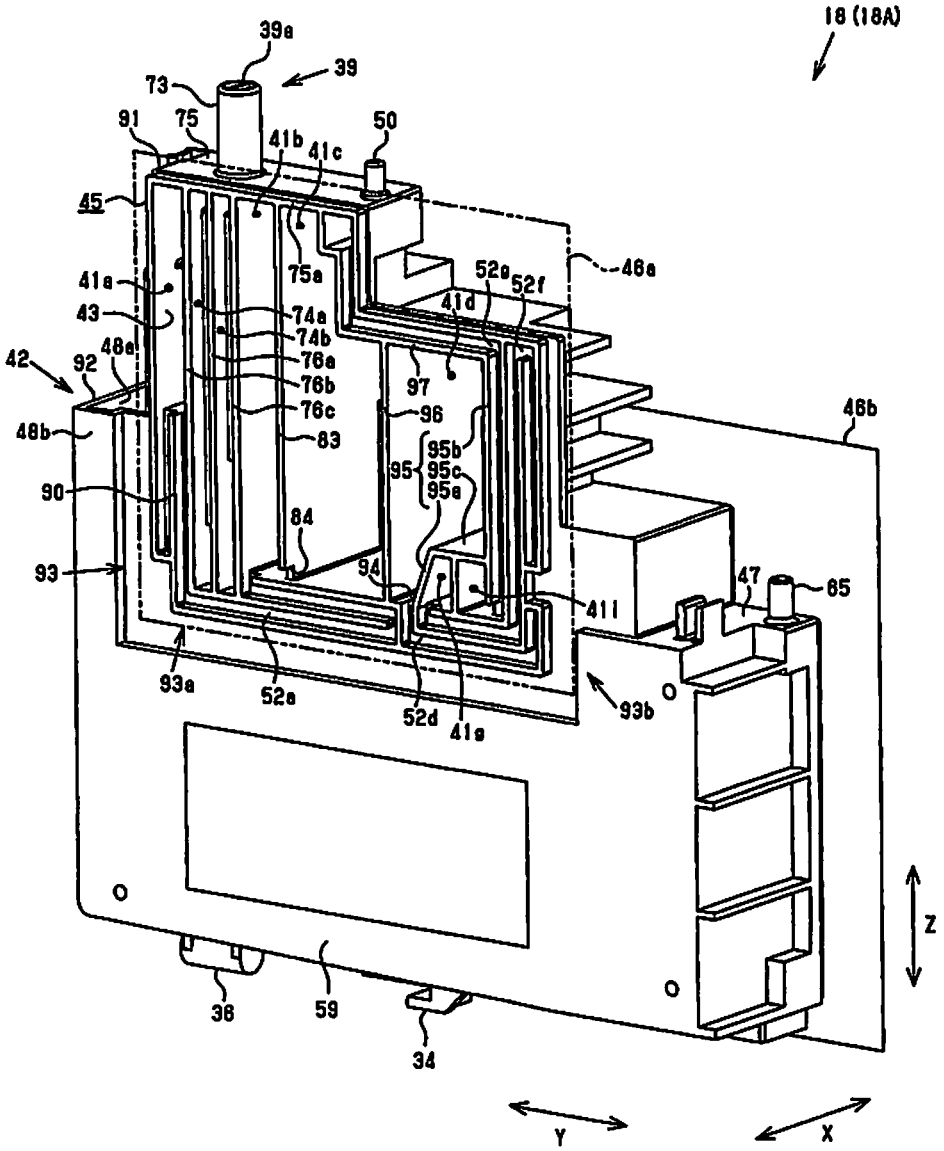
FIG. 22 is a perspective view illustrating the first ink container viewed from the right side.
Figure 23:
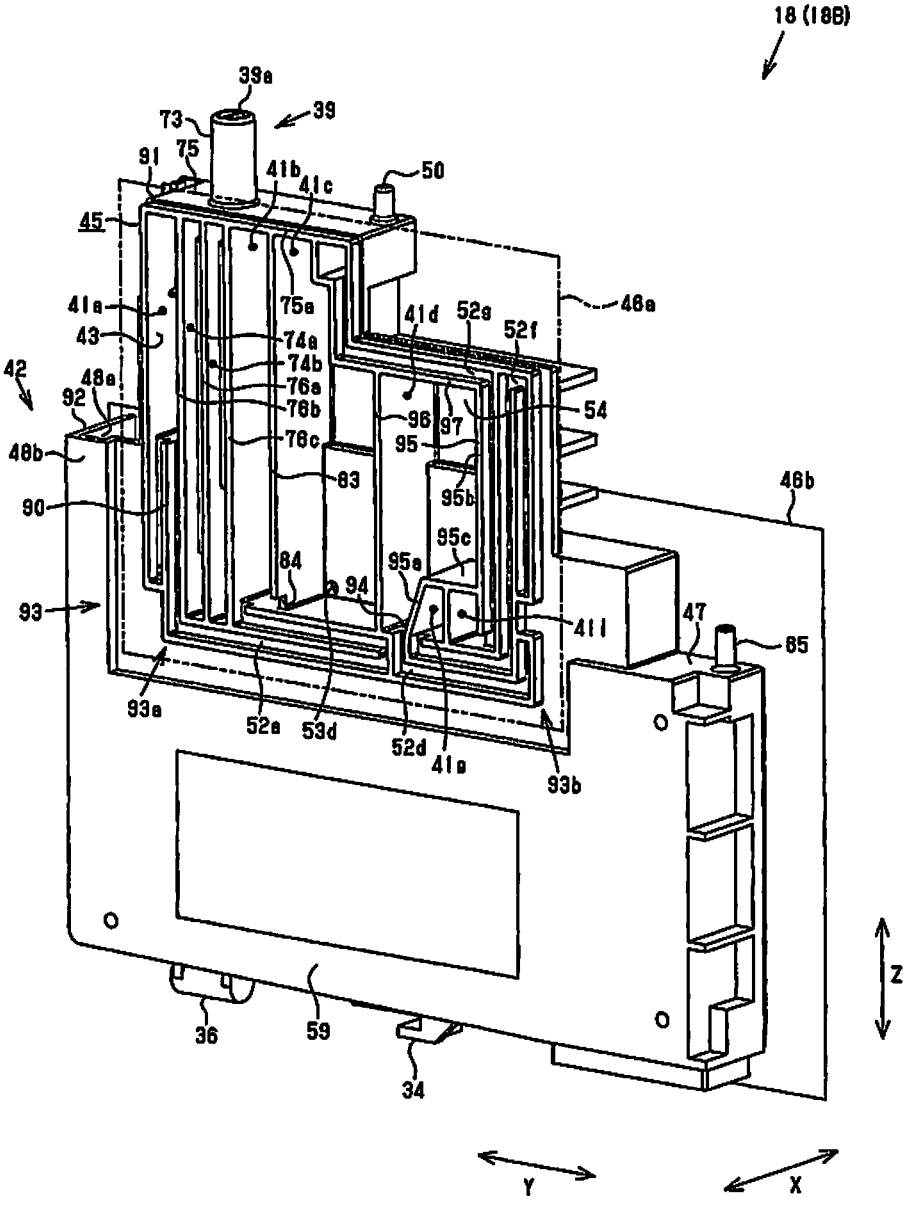
FIG. 23 is a perspective view illustrating the second ink container viewed from the right side.

As shown in FIG. 22 and FIG. 23, the rear side wall 95 is arranged to obliquely intersect with the lower wall 94, such that one end (lower end) of the rear side wall 95 intersecting with the lower wall 94 is located on the front side wall 96-side of the other end (upper end) of the rear side wall 95 intersecting with the upper wall 97. The rear side wall 95 accordingly includes an inclined wall 95*a* that is arranged to obliquely intersect with the lower wall 94, a vertical wall 95*b* that is arranged to intersect with the upper wall 97, and a lateral wall 95*c* that is located between the inclined wall 95*a* and the vertical wall 95*b*.

The inclined wall 95*a* arranged to define the fourth buffer chamber 41*d* accordingly serves as a wall to introduce ink from the sixth through hole 53*f* that is the connection port between the first air communication path 93*a* and the fourth buffer chamber 41*d* in a direction toward the center of the fourth buffer chamber 41*d*. The inclined wall 95*a* is inclined such that the width in the depth direction Y of the upper side of the fourth buffer chamber 41*d* toward the center of the fourth buffer chamber 41*d* is larger than the width of the lower side toward the second air communication path 93*b*. In other words, the inclined wall 95*a* is provided to be inclined to be further away from the front side wall 96 with an increase in distance from the lower wall 94.

The following describes the functions of the ink container 18.

Figure 24:
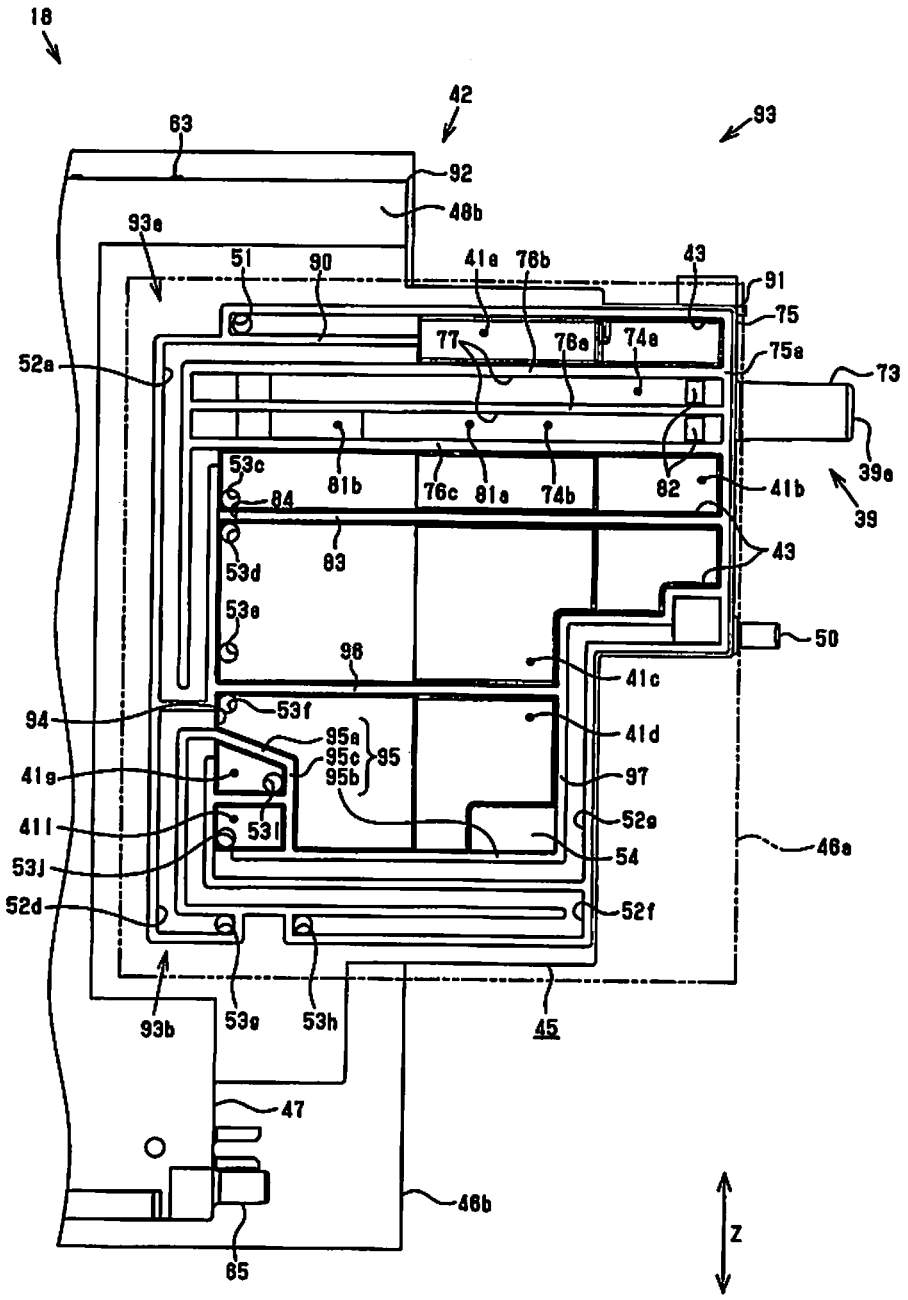
FIG. 24 is a partial side view illustrating the ink container of a changed attitude.

As shown in FIG. 24, the attitude of the ink container 18 may be changed, for example, during transfer of the complex machine 11. When ink flows from the sixth through hole 53*f* into the fourth buffer chamber 41*d*, the ink flows along the inclined wall 95*a* of the rear side wall 95 in a direction away from the fourth connecting portion 52*d*. The ink is then accumulated in a space defined by the vertical wall 95*b*, the lateral wall 95*c*, the upper wall 97, the left wall 54 and the first film 46*a*.

The configuration of the second embodiment described above has the following advantageous effects, in addition to the advantageous effects (1) to (18) of the first embodiment described above.

(19) When ink flows into the fourth buffer chamber 41*d*, the ink is introduced in the direction toward the center of the fourth buffer chamber 41*d*. This configuration causes ink to be accumulated in the fourth buffer chamber 41*d*. This reduces the possibility that ink is leaked out through the air communication path 93 and thereby reduces the possibility that the periphery of the ink container 18 is stained with ink.

(20) The inclined wall 95*a* is provided to be inclined toward the center of the fourth buffer chamber 41*d*. This configuration suppresses ink from flowing into the fourth connecting portion 52*d*. This enables the buffer function of the fourth buffer chamber 41*d* to be used effectively.

(21) The inclined wall 95*a* provided to define the fourth buffer chamber 41*d* serves to introduce ink. This configuration facilitates manufacture of the ink container 18, compared with a configuration that a wall for introducing the ink is provided separately from a wall defining the fourth buffer chamber 41*d*.

(22) The tubular body-forming wall 75*a* and the front wall 57 are connected with each other via the first corner portion 91 and the second corner portion 92. Even in the event of leakage of ink to the periphery of the tubular body 73, this configuration reduces the possibility that the leaked ink flows to the visible surface 61 to decrease the visibility and reduces the possibility that the peripheral of the ink container 18 is stained with ink.

(23) The air communication portion 50 and the tubular body 73 are provided in the tubular body-forming wall 75*a*. This configuration enables the aeration test to be readily performed by closing one of the air communication portion 50 and the opening of the tubular body 73 and flowing the air from the other.

The configurations of the above embodiments may be changed or altered like modifications described below. The configurations of the above embodiments and the configuration of the following modifications may be provided in any combinations.

Figure 25:
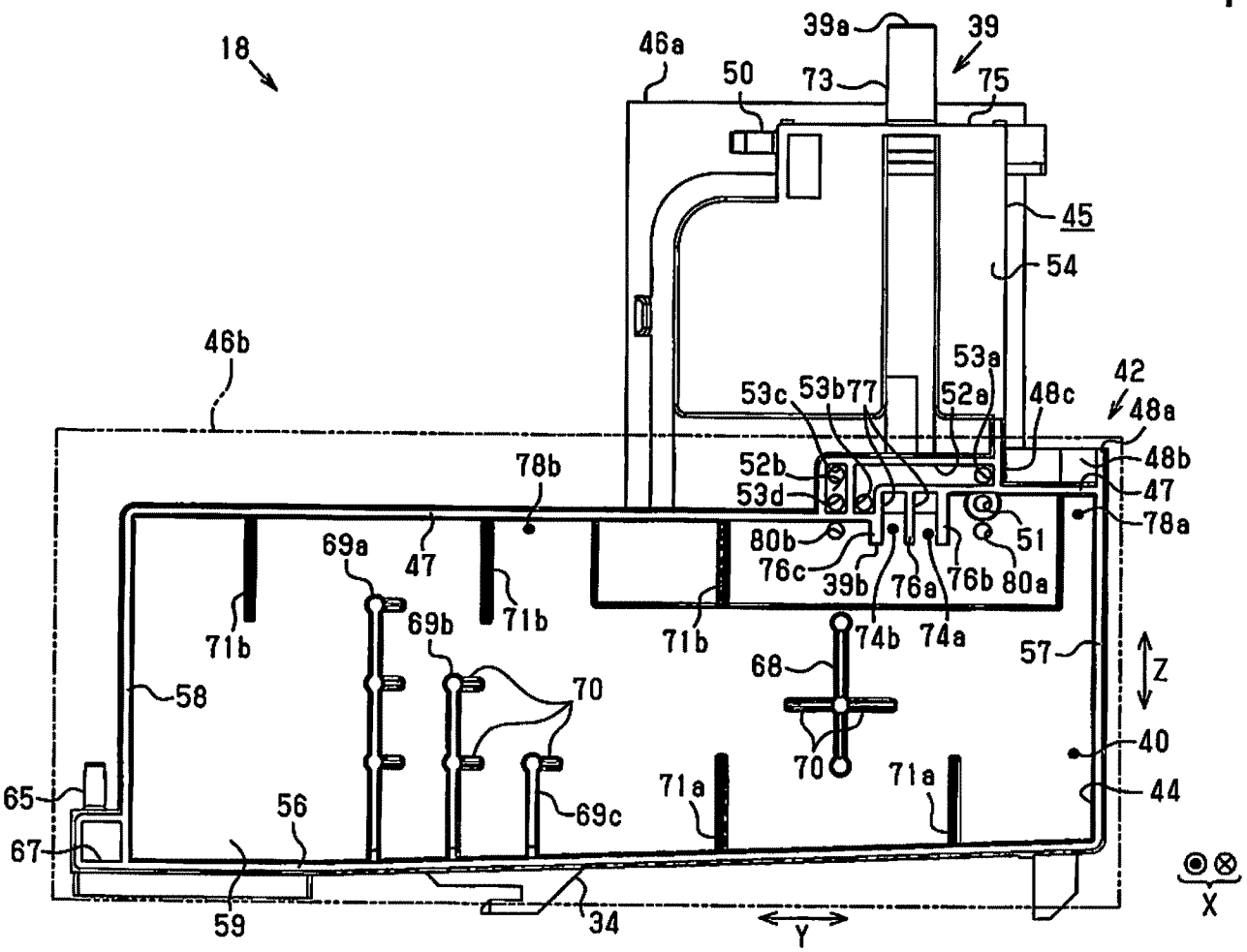
FIG. 25 is a left side view illustrating an ink container according to a modification.
Figure 26:
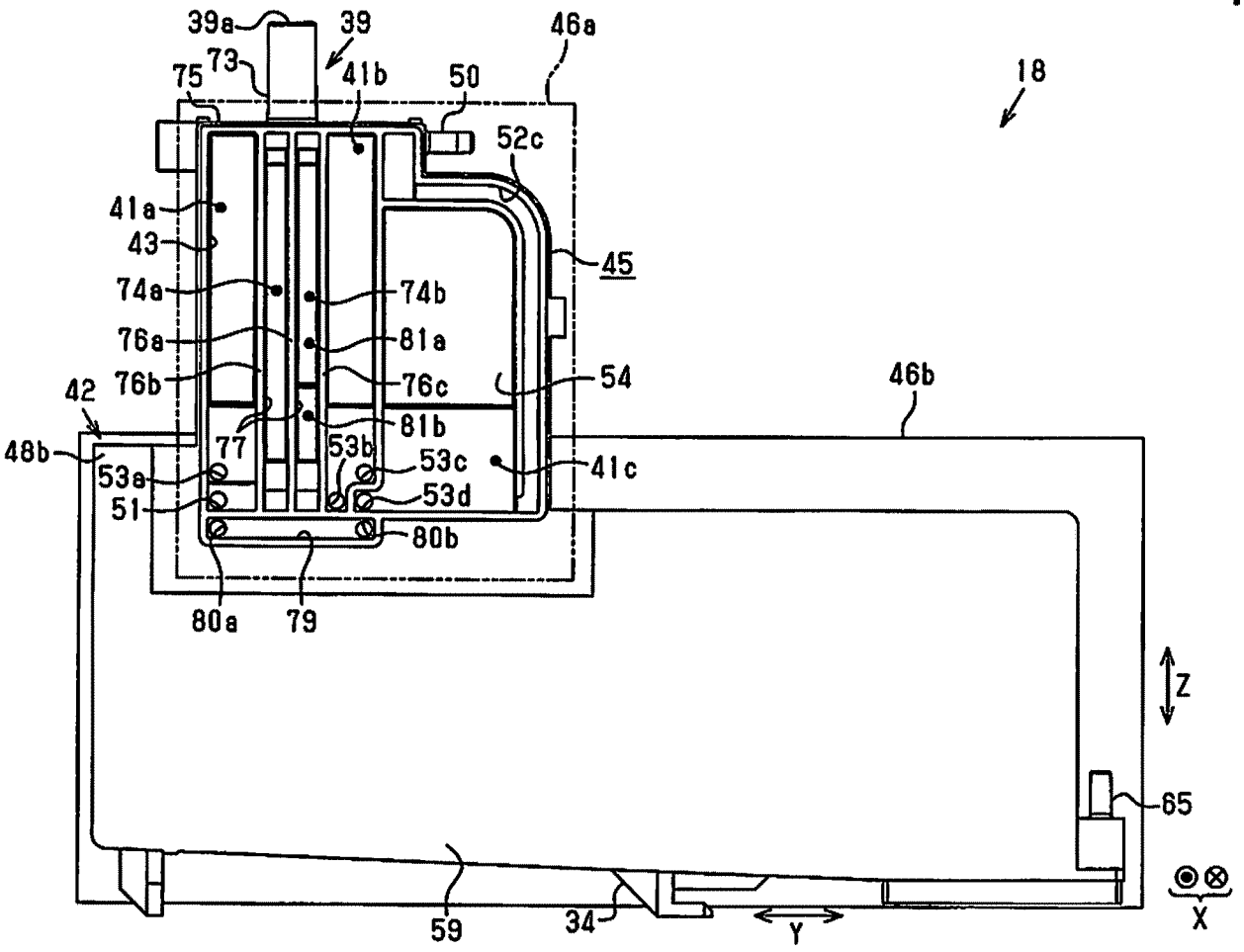
FIG. 26 is a right side view illustrating the ink container according to the modification.

As shown in FIG. 25 and FIG. 26, the air communication portion 50 may be formed to be extended along the depth direction Y.

Figure 27:
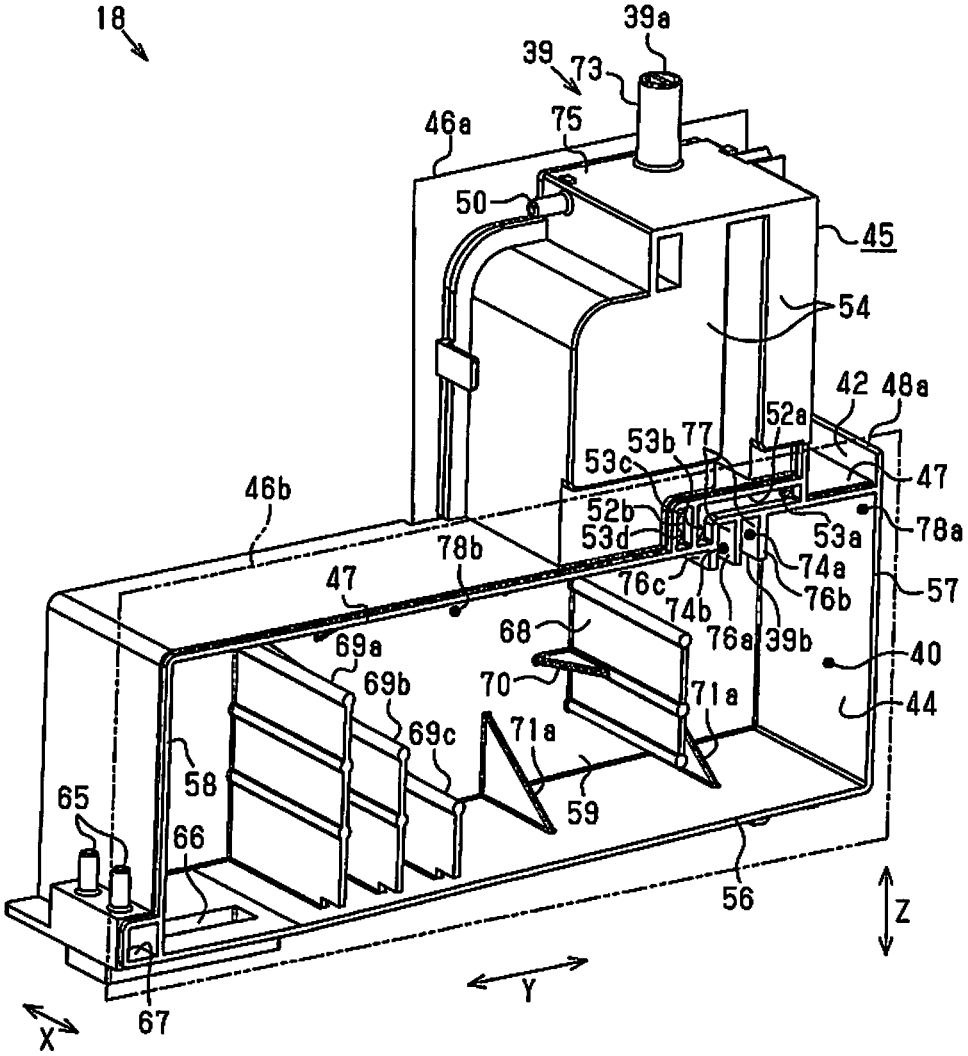
FIG. 27 is a perspective view illustrating an ink container according to a modification viewed from the left side.
Figure 28:
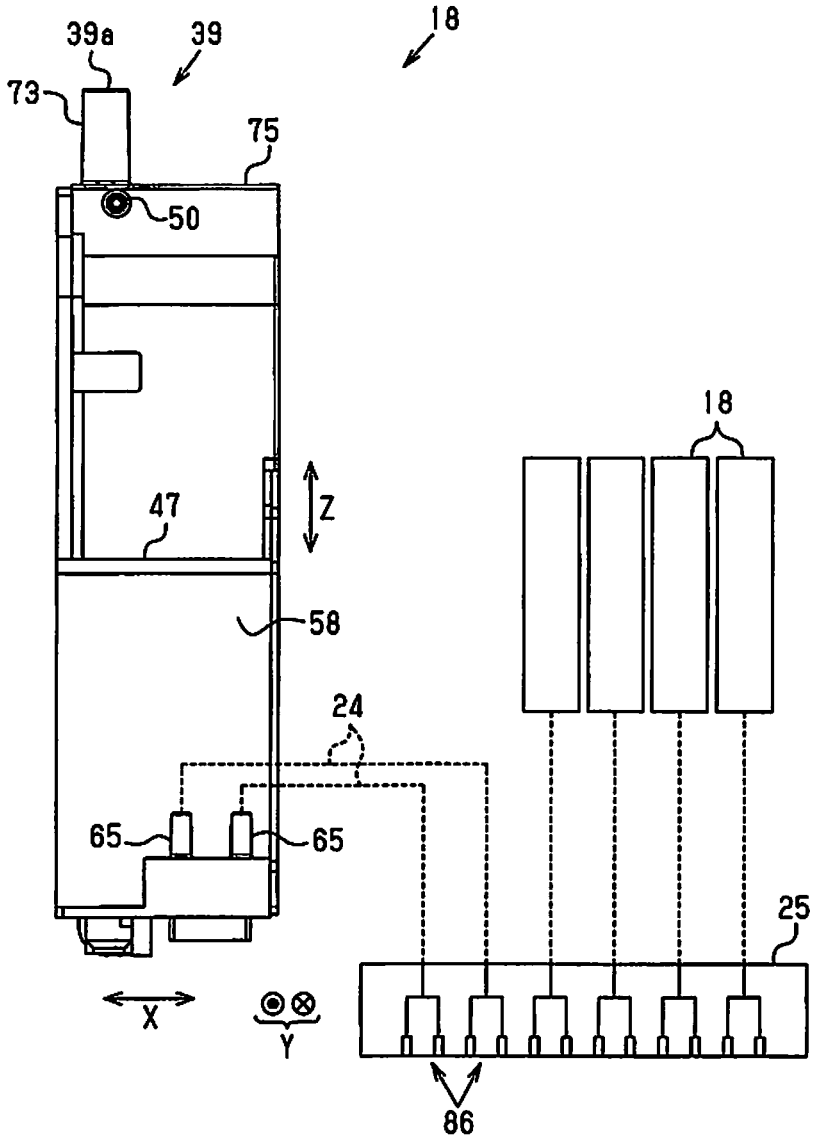
FIG. 28 is a rear side view illustrating the ink container according to the modification and a diagram illustrating an ink ejection head.

As shown in FIG. 27 and FIG. 28, a plurality of (according to this modification, two) ink discharge portions 65 may be provided for one ink container 18. Different supply portions 24 are connected with the two ink discharge portions 65. The ink ejection head 25 is configured to include a larger number of nozzle arrays 86 than the number of ink containers 18 provided in the printer 12. The supply portion 24 is arranged to connect one ink discharge portion 65 with one nozzle array 86.

Figure 29:
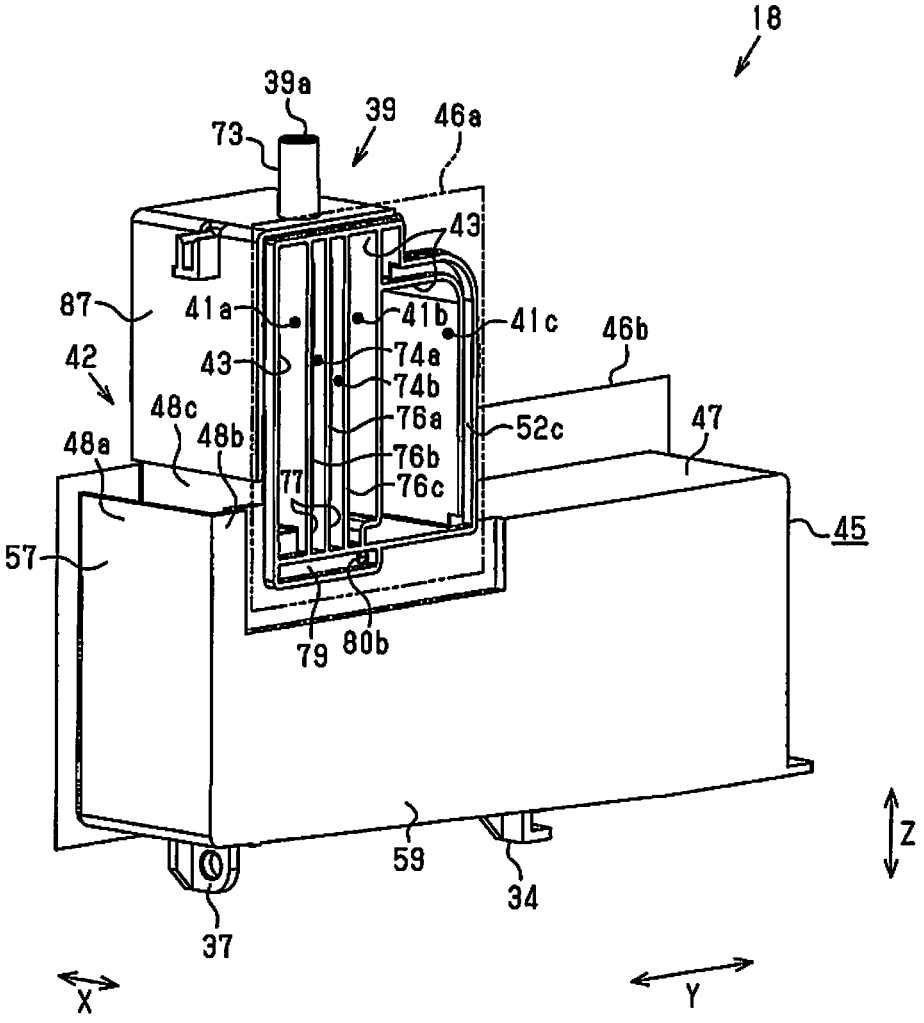
FIG. 29 is a perspective view illustrating an ink container according to a modification viewed from the right side.

As shown in FIG. 29, an absorber 87 that is capable of absorbing ink may be provided around the tubular body 73 of the ink container 18. The absorber 87 may be provided to be extended from the upper face 75 with the tubular body 73 formed thereon toward the reservoir portion 42.

As shown in FIG. 29, the ink container 18 may be provided with a locking element 37 configured to lock the mounting screw 35 to the ink container 18, and the mounting structure 33 to which the ink container 18 is mounted may be provided with a screwed element to which the mounting screw 35 is screwed.

Figure 30:
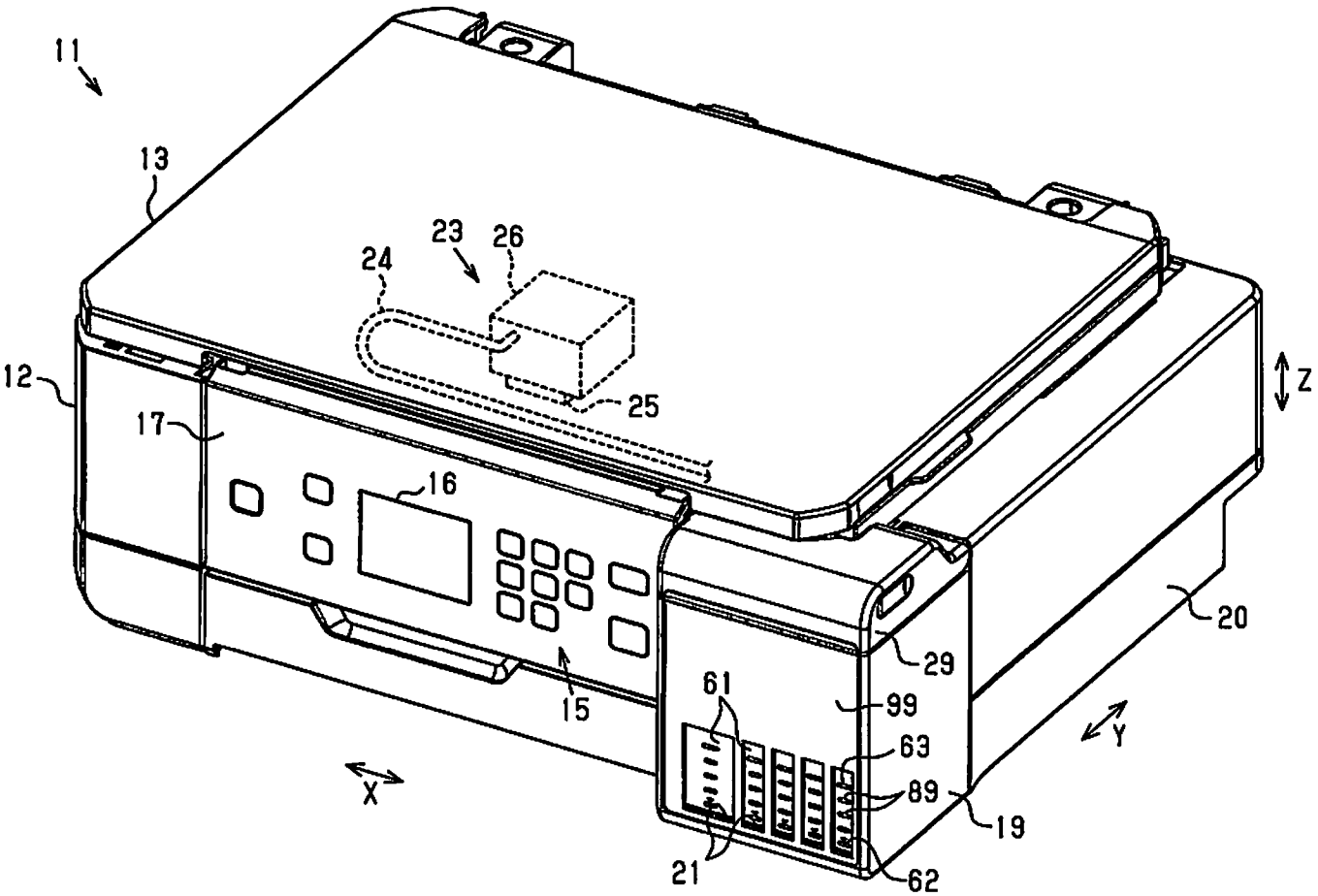
FIG. 30 is a perspective view illustrating a complex machine according to a modification.

As shown in FIG. 30, the windows 21 may be provided in a decorative panel 99 attached to a front face of the housing 20. Portions of the decorative panel 99 that are opposed to the visible surface 61 may be formed transparent to serve as the windows 21 (transparent windows). In this modification, at least one of the lower limit indicator 62, the upper limit indicator 63 and the scales 89 may be formed on the window 21 (transparent window) of the decorative panel 99. When there is a difficulty in visually checking the ink through the transparent window, through holes formed to pass through the decorative panel 99 and the housing 20 may serve as the windows 21, and at least one of the lower limit indicator 62, the upper limit indicator 63 and the scales 89 may be formed in the ink container 18 as shown in FIG. 15. When the through holes serve as the windows 21, the front wall 57 of the ink container 18 is directly visible. This configuration enables the amounts of inks to be more readily checked visually, compared with the configuration that the transparent windows serve as the windows 21.

The tubular body-forming wall 75*a* and the front wall 57 may be connected with each other via three or more corner portions.

An inclined wall 95*a* may be provided in the fourth buffer chamber 41*d* separately from the rear side wall 95 that defines the fourth buffer chamber 41*d*.

The inclined wall 95*a* configured to introduce ink may not be necessarily inclined. More specifically, the rear side wall 95 may be formed to perpendicular intersect with the lower wall 94. The rear side wall 95 may be configured to introduce ink by forming a groove or by adjusting the hydrophilicity or the hydrophobicity.

The ink inlet flow path portion 39 may not be necessarily provided with the tubular body 73. For example, the ink inlet flow path portion 39 may be formed by sealing a groove formed from the first end portion 39*a* to the second end portion 39*b* with a film. Accordingly, the first end portion 39*a* may be formed by a groove and a film.

The operation panel 17 may be provided with a touch panel that allows for both display and operation, as the display unit 16.

The ink container 18 may be configured, such that the first end portion 39*a* is located below the display unit 16.

The ink container 18 may not be necessarily provided with the reservoir portion 42. The reservoir portion 42 may be formed by sealing openings formed in two side directions (for example, right side direction and left side direction) with the first film 46*a* and the second film 46*b*.

The buffer recesses 43 and the chamber recess 44 may be formed to be open in the same direction. The buffer recesses 43 and the chamber recess 44 may be sealed with one identical film. The ink inlet flow path portion 39 may be formed by sealing a groove formed in one direction with a film.

The total volume of the first upper space 78*a* and the second upper space 78*b* may be larger than the volume of one of the first ink flow path 74*a* and the second ink flow path 74*b*. It is preferable that the total volume of the first upper space 78*a* and the second upper space 78*b* is larger than the volume of the first ink flow path 74*a* that serves as the flow path for ink. total volume of the first upper space 78*a* and the second upper space 78*b*

The ink injection flow path 39 may be provided at an end of the ink chamber 40. In other words, the upper space of the ink chamber 40 may not be necessarily divided into the first upper space 78*a* and the second upper space 78*b*.

The ink container 18 may be configured to exclude the buffer chambers 41*a* to 41*i* and the communication portion 51.

The ink container 18 may be configured to exclude the visible surface 61. The visible surface 61 may not be necessarily provided with the upper limit indicator 63. The visible surface 61 may not be necessarily provided with the lower limit indicator 62. The visible surface 61 may be a surface arranged to intersect with the vertical direction Z.

The second end portion 39-side of the ink inlet flow path portion 39 may be formed at a different position from the ceiling wall 47. For example, the second end portion 39*b* may be formed to be open to the right wall 59.

The second end portion 39*b* of the first ink flow path 74*a* and the second end portion 39*b* of the second ink flow path 74*b* may be located at different positions in the vertical direction Z. In this case, it is preferable that the second end portion 39*b* of the second ink flow path 74*b* is located above the second end portion 39*b* of the first ink flow path 74*a*.

The first ink flow path 74*a* may be configured to include a first flow path portion 81*a* and a second flow path portion 81*b*, like the second ink flow path 74*b*. In this case, a lower end of the first flow path portion 81*a* of the first ink flow path 74*a* may be located at a different position in the vertical direction from that of a lower end of the first flow path portion 81*a* of the second ink flow path 74*b*. This configuration reduces the possibility that ink is balanced and remains in the flow path portions 81*a* and 81*b*. At least one of the first ink flow path 74*a* and the second ink flow path 74*b* may be configured to include a plurality of at least one flow path portions out of the first flow path portion 81*a* and the second flow path portion 81*b*. The second ink flow path 74*b* may be configured to exclude the second flow path portion 81*b*, like the first ink flow path 74*a*. The first ink flow path 74*a* and the second ink flow path 74*b* may have different thicknesses (different sectional areas).

The ink inlet flow path portion 39 may be configured to include one ink flow path. The ink inlet flow path portion 39 may also be configured to include three or more ink flow paths.

Ink may be arbitrarily selected as long as printing may be performed on a medium by adhesion of the ink to the medium. For example, the ink includes solutions, dispersions and mixtures of functional solid material particles, such as pigment particles or metal particles, solved in, dispersed in or mixed with solvents and also includes water-based inks and oil-based inks, as well as various compositions, such as gel inks and hot-melt inks.

The medium may be any of papers, resins, metals, cloths, ceramics, rubbers, natural materials (timbers and stones) and their composite bodies. The medium may have various thicknesses like plates, sheets, films and foils. Additionally, the medium may be in any shape such as rectangular shape or circular shape. For example, the medium may be a composite film of paper and resin (for example, resin-impregnated paper or resin-coated paper), a composite film of resin and metal (laminated film), a woven fabric, a non-woven fabric, a disk or a circuit board.

The printer is an apparatus configured to print images such as letters, graphics and photographs by adhesion of a liquid such as ink to a medium and may be a serial printer, a lateral printer, a line printer, or a page printer. The printer may also be an offset printing apparatus or a textile printing apparatus. The printer may be any apparatus having at least the printing function to perform printing on a medium and may be a complex machine having another function in addition to the printing function. The printer may be an apparatus configured to perform printing not only on a two-dimensional medium but on a medium having a three-dimensional curved surface.

The following additionally describes the technical ideas understood from the embodiments and the modifications described above.

The ink cartridge such as that described in JP 2008-183836A may be configured to communicate with the outside air by an air communication path. In this ink cartridge, however, for example, in response to a change in attitude or in response to a change in temperature, ink contained in the ink cartridge may enter the air communication path to be leaked out. During ink refill into the ink cartridge, the ink cartridge and the periphery of the ink cartridge may be stained with spilt ink. An object of the technical ideas is to provide an ink container that reduces the possibility that the ink container and its periphery are stained with ink, as well as a printer equipped with such an ink container.

Technical Idea 1

There is provided an ink container comprising an ink chamber configured to contain ink that is to be supplied to an ink ejection head; an ink inlet flow path portion configured to inject ink into the ink chamber; and a buffer chamber provided in the middle of an air communication path that is arranged to cause the ink chamber to communicate with the outside air. The buffer chamber includes a wall arranged to introduce the ink from a connection port between the air communication path on the ink chamber-side and the buffer chamber in a direction toward center of the buffer chamber.

When ink flows into the buffer chamber, this configuration causes the ink to be introduced in the direction toward the center of the buffer chamber. This enables the ink to be accumulated in the buffer chamber. This reduces the possibility that ink is lead out through the air communication path and thereby reduces the possibility that the periphery of the ink container is stained with ink.

Technical Idea 2

In the ink container described in the technical idea 1, the wall may be inclined such that such that the width of a side of the buffer chamber toward the center of the buffer chamber is larger than the width of a side of the buffer chamber toward the air communication path on the open airside.

In the ink container of this configuration, the wall is provided to be inclined toward the center of the buffer chamber. This configuration accordingly suppresses ink flow flowing into the air communication path on the open airside. This enables the buffer function of the buffer chamber to be used effectively.

Technical Idea 3

In the ink container described in either the technical idea 1 or the technical idea 2, the wall may be a wall defining the buffer chamber.

In the ink container of this configuration, the wall provided to define the buffer chamber serves to introduce ink. This configuration facilitates manufacture of the ink container, compared with a configuration that a wall for introducing the ink is provided separately from a wall defining the buffer chamber.

Technical Idea 4

There is provided an ink container comprising an ink chamber configured to contain ink that is to be supplied to an ink ejection head; a tubular body including an opening configured to inject ink into the ink chamber; a first wall in which the tubular body is formed; and a second wall provided to define the ink chamber and configured to cause the ink contained in the ink chamber to be visible from outside of the ink chamber. The first wall and the second wall are connected with each other via a plurality of corner portions.

In the ink container of this configuration, the first wall and the second wall are connected with each other via the plurality of corner portions. Even in the event of leakage of ink to the periphery of the tubular body, this configuration reduces the possibility that the leaked ink flows to a visible surface to decrease the visibility and reduces the possibility that the peripheral of the ink container is stained with ink.

Technical Idea 5

In the ink container described in the technical idea 4, the first wall may be provided with an air communication portion that causes inside of the ink chamber to communicate with the outside air.

In the ink container of this configuration, the air communication portion and the tubular body are provided in the first wall. This configuration enables an aeration test to be readily performed by closing one of the air communication portion and the opening of the tubular body and flowing the air from the other.

What is claimed is:

1. An ink container, comprising:

an ink chamber configured to contain ink that is supplied to an ink ejection head; and an ink inlet flow path portion including a plurality of ink flow paths, each of the plurality of ink flow paths being arranged to connect a first end portion that is open upward to outside of the ink chamber with a second end portion that is open to inside of the ink chamber and configured to inject the ink into the ink chamber, at least part of the ink inlet flow path portion being formed by sealing a groove that is defined by a flow path wall with a film attached to the flow path wall, the first end portion being open upward in both of a state where the ink is supplied from the ink chamber to the ink ejection head and a state where the ink is injected to the ink chamber through the ink inlet flow path portion, and the plurality of ink flow paths being arranged parallel to each other.

2. The ink container according to claim 1, wherein at least one ink flow path of the plurality of ink flow paths is configured to include a first flow path portion, and a second flow path portion that has a larger sectional area than a sectional area of the first flow path portion.

3. The ink container according to claim 1, wherein the second end portion of each of the plurality of ink flow paths is located at an identical height in the ink chamber.

4. The ink container according to claim 1, wherein a second end portion-side of the ink inlet flow path portion is located in an upper space of the ink chamber, the second end portion-side of the ink inlet flow path portion is formed to be protruded downward from a ceiling wall that is configured to define the ink chamber.

5. The ink container according to claim 1, wherein the ink chamber is defined by a ceiling wall and a side wall, the side wall is extended in a direction intersecting with the ceiling wall, the side wall stands in a vertical direction when the ink container is in use, and the side wall includes a visible surface through which the ink inside the ink chamber is visually recognized from outside, the visible surface is provided with an upper limit indicator that gives a rough indication of an upper limit of an amount of refilled ink, and the second end portion of the ink inlet flow path portion is located at a position corresponding to the upper limit indicator in the vertical direction.

6. The ink container according to claim 1, further comprising:

a buffer chamber provided along the ink inlet flow path portion; and a communication portion configured to communicate with the buffer chamber and the ink chamber.

7. The ink container according to claim 6, wherein the buffer chamber is formed by sealing a buffer recess that has one open surface, with the film.

8. The ink container according to claim 1, wherein the film includes a first film sealing a portion of the groove and forming a portion of the ink inlet flow path portion, and a second film sealing a portion of the groove and forming the second end portion of the ink inlet flow path portion, and the ink chamber is formed by sealing a chamber recess that has one open surface, with the second film.

9. A printer, comprising:

the ink container according to claim 1;

an ink ejection head configured to eject the ink;

a housing configured to place the ink container and the ink ejection head therein; and an operation panel provided on the housing, wherein the operation panel includes a display unit, the ink container is arranged such that at least part of the ink container is located at a height equal to a height of the operation panel, and during injection of the ink into the ink chamber through the ink inlet flow path portion, the first end portion of the ink inlet flow path portion is located above the display unit.

10. The ink container according to claim 1, further comprising a buffer chamber provided in middle of an air communication path that is configured to communicate with the ink chamber and outside air, wherein the buffer chamber includes a wall configured to introduce the ink from a connection port between the air communication path on an ink chamber-side and the buffer chamber in a direction toward center of the buffer chamber.

11. An ink container, comprising:

an ink chamber configured to contain ink that is supplied to an ink ejection head;

an ink inlet flow path portion arranged to connect a first end portion that is open to outside of the ink chamber with a second end portion that is open to inside of the ink chamber and configured to inject the ink into the ink chamber;

a buffer chamber provided along the ink inlet flow path portion;

a communication portion configured to communicate with the buffer chamber and the ink chamber; and an air communication portion configured to communicate with the buffer chamber and outside air, at least part of the ink inlet flow path portion being formed by sealing a groove that is defined by a flow path wall with a film attached to the flow path wall, and when the ink container is in use, the communication portion communicating with the ink chamber at a position above the second end portion.

12. The ink container according to claim 11, wherein an upper space of the ink chamber above the second end portion is divided into a first upper space and a second upper space by the ink inlet flow path portion when the ink container is in use, the ink container further comprising a communication path configured to communicate with the first upper space and the second upper space.

13. The ink container according to claim 11, wherein when the ink container is in use, an upper space of the ink chamber above the second end portion has a volume that is larger than a volume of the ink inlet flow path portion.

14. An ink container, comprising:

an ink chamber configured to contain ink that is supplied to an ink ejection head;

an ink inlet flow path portion arranged to connect a first end portion that is open to outside of the ink chamber with a second end portion that is open to inside of the ink chamber and configured to inject the ink into the ink chamber; and a reservoir portion located at a position below the first end portion when the ink container is in use, and configured to accumulate ink flowing from the first end portion to an outside of the ink inlet flow path portion, at least part of the ink inlet flow path portion being formed by sealing a groove that is defined by a flow path wall with a film attached to the flow path wall, the reservoir portion being defined by a ceiling wall defining the ink chamber, a reservoir wall standing upward from the ceiling wall and including an opening on part of a lateral side, and a film sealing the opening that faces the lateral side of the reservoir wall, and the reservoir portion being arranged to be open upward.

* * * * *